US009984840B2

(12) United States Patent
Hsu

(10) Patent No.: US 9,984,840 B2
(45) Date of Patent: May 29, 2018

(54) KEYSWITCH STRUCTURE, SWITCH STRUCTURE AND METHOD OF ASSEMBLING A KEYSWITCH STRUCTURE

(71) Applicants: DARFON ELECTRONICS (SUZHOU) CO., LTD., Suzhou, Jiangsu Province (CN); DARFON ELECTRONICS CORP., Taoyuan (TW)

(72) Inventor: Chien-Shih Hsu, Taoyuan (TW)

(73) Assignees: DARFON ELECTRONICS (SUZHOU) CO., LTD., Suzhou, Jiangsu Province (CN); DARFON ELECTRONICS CORP., Taoyuan (TW)

( * ) Notice: Subject to any disclaimer, the term of this patent is extended or adjusted under 35 U.S.C. 154(b) by 0 days. days.

(21) Appl. No.: 15/382,728

(22) Filed: Dec. 18, 2016

(65) Prior Publication Data

US 2017/0178841 A1 Jun. 22, 2017

(30) Foreign Application Priority Data

Dec. 18, 2015 (TW) ..... 104142691 A
Dec. 15, 2016 (TW) ..... 105141509 A

(51) Int. Cl.
*H01H 36/00* (2006.01)
*H01H 13/85* (2006.01)
(Continued)

(52) U.S. Cl.
CPC ..... *H01H 13/85* (2013.01); *H01H 1/54* (2013.01); *H01H 3/12* (2013.01); *H01H 11/00* (2013.01);
(Continued)

(58) Field of Classification Search
CPC ..... H01H 36/00; H01H 36/0073; H01H 36/0006; H01H 5/02; H01H 2003/506;
(Continued)

(56) References Cited

U.S. PATENT DOCUMENTS 7,449,651 B2 * 11/2008 Lin ..... H01H 3/125 200/344
7,683,280 B2 * 3/2010 Hsu ..... H01H 3/125 200/344
(Continued)

FOREIGN PATENT DOCUMENTS

CN 104051175 A 9/2014
CN 104576136 A 4/2015
(Continued)

*Primary Examiner* — Ahmed Saeed
(74) *Attorney, Agent, or Firm* — Winston Hsu

(57) ABSTRACT

A keyswitch structure includes a base, a keycap, a frame disposed between the base and the keycap for providing a supporting and moving mechanism to the keycap, and another frame interacting with the former frame through a magnetic attraction force. When the keycap is not pressed, the magnetic attraction force drives the two frames to stably stand on the base and form a stable supporting structure, so that the keycap is located at a farther position relative to the base. When the keycap is pressed with an external force to move toward the base, the magnetic attraction force is overcome so that the two frames depart from each other; that is, the above stable supporting structure is temporarily destroyed. Once the external force applied to the keycap is eliminated, the two frames will form the stable supporting structure again due to the magnetic attraction force.

14 Claims, 37 Drawing Sheets

(51) Int. Cl.

| | |
|---|---|
| ***H01H 13/14*** | (2006.01) |
| ***H01H 3/12*** | (2006.01) |
| ***H01H 13/06*** | (2006.01) |
| ***H01H 1/54*** | (2006.01) |
| ***H01H 11/00*** | (2006.01) |

(52) U.S. Cl.
CPC ..... *H01H 13/06* (2013.01); *H01H 13/14* (2013.01); *H01H 2215/00* (2013.01); *H01H 2221/058* (2013.01)

(58) Field of Classification Search
CPC ..... H01H 2001/545; H01H 36/002; H01H 36/008; H01H 9/443; H01H 13/85; H01H 13/7065; H01H 3/125; H01H 13/705
USPC ... 200/5 A, 341–345, 314, 82 E, 334, 19.36; 335/205–207
See application file for complete search history.

(56) References Cited

U.S. PATENT DOCUMENTS

| | | | | |
|---|---|---|---|---|
| 8,912,458 | B2 * | 12/2014 | Peterson | G06F 3/0202 200/344 |
| 8,970,331 | B2 * | 3/2015 | Chang | H01H 13/702 200/341 |
| 9,343,247 | B2 * | 5/2016 | Hsu | H01H 13/20 |
| 2006/0238281 | A1 | 10/2006 | Steinberg | |
| 2008/0061565 | A1 | 3/2008 | Lee | |
| 2009/0273437 | A1 | 11/2009 | Kopken | |
| 2010/0314230 | A1 | 12/2010 | Hsu | |
| 2014/0034468 | A1 * | 2/2014 | Krumpelman | H01H 3/122 200/5 A |
| 2015/0047959 | A1 * | 2/2015 | Wu | H01H 3/125 200/344 |
| 2016/0329172 | A1 | 11/2016 | Huang | |

FOREIGN PATENT DOCUMENTS

| | | | |
|---|---|---|---|
| CN | 104992867 | A | 10/2015 |
| TW | M416801 | U1 | 11/2011 |
| TW | M467938 | U | 12/2013 |
| TW | 201434064 | A | 9/2014 |
| TW | I489497 | B | 6/2015 |

* cited by examiner

KEYSWITCH STRUCTURE, SWITCH STRUCTURE AND METHOD OF ASSEMBLING A KEYSWITCH STRUCTURE

BACKGROUND OF THE INVENTION

1. Field of the Invention

The invention relates to a keyswitch structure and a switch structure, and especially relates to a keyswitch structure and a switch structure which use a magnetic attraction force as a return force.

2. Description of the Prior Art

Conventional keyswitch structures use an elastic member (e.g. a rubber dome) disposed under a keycap for providing a return force to the keycap to directly drive the keycap to return to its original position (e.g. a position where the keycap is not pressed). In order to provide a user enough tactile feeling by pressing feedback (i.e. the magnitude and variation of a reaction force received by the user when the user presses the keycap), it is usually difficult to reduce the size of the elastic member, so that it is hard to apply this kind of keyswitch structures to thin keyboards. Furthermore, using an elastic member having a relatively large volume will affect the structural strength and stability of other members (e.g. a lift mechanism by which the keycap can move up and down). This problem will be more serious in thin keyboards. Therefore, it is indeed hard to apply this kind of keyswitch structures to thin keyboards unless a reduction or loss of the action stability or tactile feeling by pressing feedback is involved. In addition, the conventional keyswitch structure uses the shape deformation of the elastic member under the keycap to provide return force for the keycap to move upward, so the service life of the conventional keyswitch structure usually depends on the deformation durability of the elastic member.

SUMMARY OF THE INVENTION

An objective of the invention is to provide a keyswitch structure, a switch structure, and a method of assembling the keyswitch structure. Therein, the keyswitch structure and the switch structure include frames interacting with each other with magnetic attraction force. The magnetic attraction force is taken as a return force for a keycap thereof, so that the keyswitch structure and the switch structure do not need a space for the disposition and action of a rubber dome and still can provide a user enough tactile feeling by pressing feedback. In addition, the magnetic attraction force does not come from the shape deformation of any member in the keyswitch structure and the switch structure, so the service life of the keyswitch structure and the switch structure is longer than conventional keyswitch structures.

A keyswitch structure of an embodiment according to the invention includes a keycap, a base, a first frame, and a third frame. The first frame is disposed between the keycap and the base. The first frame includes a first magnetic portion. The keycap is supported on the first frame and can move up and down relative to the base through the first frame. The third frame is disposed between the keycap and the base and includes a supporting portion and a second magnetic portion. The third frame is supported on the base through the supporting portion. The second magnetic portion is located between the keycap and the first magnetic portion. The second magnetic portion and the first magnetic portion produce a magnetic attraction force therebetween. Therein, when the keycap is not pressed with any external force, the magnetic attraction force drives the first magnetic portion and the second magnetic portion to approach each other so that the first frame and the third frame are supported on the base stably. When the keycap is pressed with an external force to move toward the base, the first frame rotates toward the base so that the first magnetic portion and the second magnetic portion depart from each other.

A keyswitch structure of another embodiment according to the invention includes a keycap, a base, a first frame, and a third frame. The base includes a first switch contact and a second switch contact. The first frame is disposed between the keycap and the base. The first frame includes a first magnetic portion. The keycap is supported on the first frame and is up and down movable relative to the base through the first frame. The third frame is disposed between the keycap and the base and includes a supporting portion, a second magnetic portion, and a triggering portion. The supporting portion and the triggering portion are located at two opposite sides of the third frame respectively. The third frame is rotatably supported on the base through the supporting portion. The second magnetic portion is located between the keycap and the first magnetic portion. The second magnetic portion and the first magnetic portion produce a magnetic attraction force therebetween. Therein, when the keycap is not pressed with any external force, the magnetic attraction force drives the first magnetic portion and the second magnetic portion to approach each other so that the first frame and the third frame are supported on the base stably to render the keycap located at an unpressed position. When the keycap is pressed with an external force to move downward from the unpressed position toward to a triggering position, the first magnetic portion and the second magnetic portion depart from each other, the magnetic attraction force drives the third frame to rotate about the supporting portion, and the triggering portion moves toward the base. When the keycap moves toward the base to the triggering position, the third frame abuts against the second switch contact through the triggering portion so that the first switch contact and the second switch contact are electrically conducted.

A keyswitch structure of another embodiment according to the invention includes a keycap, a lower plate, a return force device, an upper cover, and a scissors structure. The return force device is disposed between the lower plate and the keycap. The return force device provides the keycap a return force, so that the keycap moves from a pressed position toward an unpressed position. The upper cover is disposed on the lower plate. The upper cover and the lower plate form an accommodating space. The return force device is located in the accommodating space. The scissors structure is disposed between the keycap and the lower plate. The scissors structure has a first frame and a second frame. The keycap is up and down movable between the unpressed position and the pressed position through the scissors structure. Therein, the first frame has a first frame upper end and a first frame lower end. The first frame upper end extends above the upper cover to connect with the keycap. The first frame lower end is located in the accommodating space to connect with at least one of the lower plate and an inner surface of the upper cover. The second frame has a second frame upper end and a second frame lower end. The second frame upper end is connected to the keycap. The second frame lower end is connected to an outer surface of the upper cover without entering the accommodating space.

A switch structure of another embodiment according to the invention includes a keycap, a carrier, a first terminal, a second terminal, a first frame, and a third frame. The first terminal is fixed on the carrier. The first terminal includes a first switch contact and a first exposed contact electrically connected to the first switch contact. The second terminal is fixed on the carrier. The second terminal includes a second switch contact and a second exposed contact electrically connected to the second switch contact. The first frame is disposed between the keycap and the carrier. The first frame includes a first magnetic portion. The keycap is supported on the first frame and is up and down movable relative to the carrier through the first frame. The third frame is disposed between the keycap and the carrier and includes a supporting portion, a second magnetic portion, and a triggering portion. The third frame is rotatably supported on the carrier through the supporting portion. The second magnetic portion is located between the keycap and the first magnetic portion. The second magnetic portion and the first magnetic portion produce a magnetic attraction force therebetween. Therein, when the keycap is not pressed with any external force, the magnetic attraction force drives the first magnetic portion and the second magnetic portion to approach each other so that the first frame and the third frame are supported on the carrier stably to render the keycap located at an unpressed position. When the keycap is pressed with an external force to move downward from the unpressed position toward to a triggering position, the first magnetic portion and the second magnetic portion depart from each other, and the triggering portion moves toward the carrier. When the keycap moves toward the carrier to the triggering position, the third frame electrically conduct the first switch contact and the second switch contact through the triggering portion.

In practice, the magnitude of the magnetic attraction force also can be determined by the material of the structures for magnetic interaction, not limited to only by the sizes of the structures. Therefore, the structures used for producing the magnetic attraction force can occupy a relatively small space for disposition and action, which is conducive to avoiding an excessive influence on the structural strength and action stability of the first frame so that the keyswitch structure is suitable for thin keyboards. Furthermore, the magnetic attraction force non-linearly decreases as the distance between the two magnetic portions increases, which facilitates a significant tactile feedback to the user. Furthermore, the magnetic attraction force with a required magnitude can be easily obtained by choosing the material of the two magnetic portions and provides an enough feedback force to the user.

For a method of assembling a keyswitch structure according to the invention, the keyswitch structure includes a keycap, a lower plate, a return force device, an upper cover, and a scissors structure. The upper cover is disposed on the lower plate. The upper cover and the lower plate form an accommodating space. The return force device is located in the accommodating space. The scissors structure is disposed between the keycap and the lower plate. The scissors structure has a first frame and a second frame. The first frame has a first frame upper end and a first frame lower end. The second frame has a second frame upper end and a second frame lower end. The method includes the following steps of: making the first frame upper end pass through the upper cover from a bottom of the upper cover so that the first frame upper end extends out above the upper cover and the first frame lower end is located below the upper cover; engaging the upper cover with the lower plate and making the first frame lower end connect with at least one of the lower plate and an inner surface of the upper cover; making the second frame and the first frame be pivotally connected and making the second frame lower end connect with an outer surface of the upper cover; and making the first frame upper end and the second frame upper end connect with the keycap.

Therefore, compared with the prior art, the keyswitch structure and the switch structure according to the invention can provide enough tactile feeling by pressing feedback to the user (i.e. the magnitude and variation of a reaction force received by the user when the user is pressing the keycap) and is suitable for thin design. Therefore, the invention can effectively solve the dilemma problem in miniaturization design of thin keyboards in the prior art.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
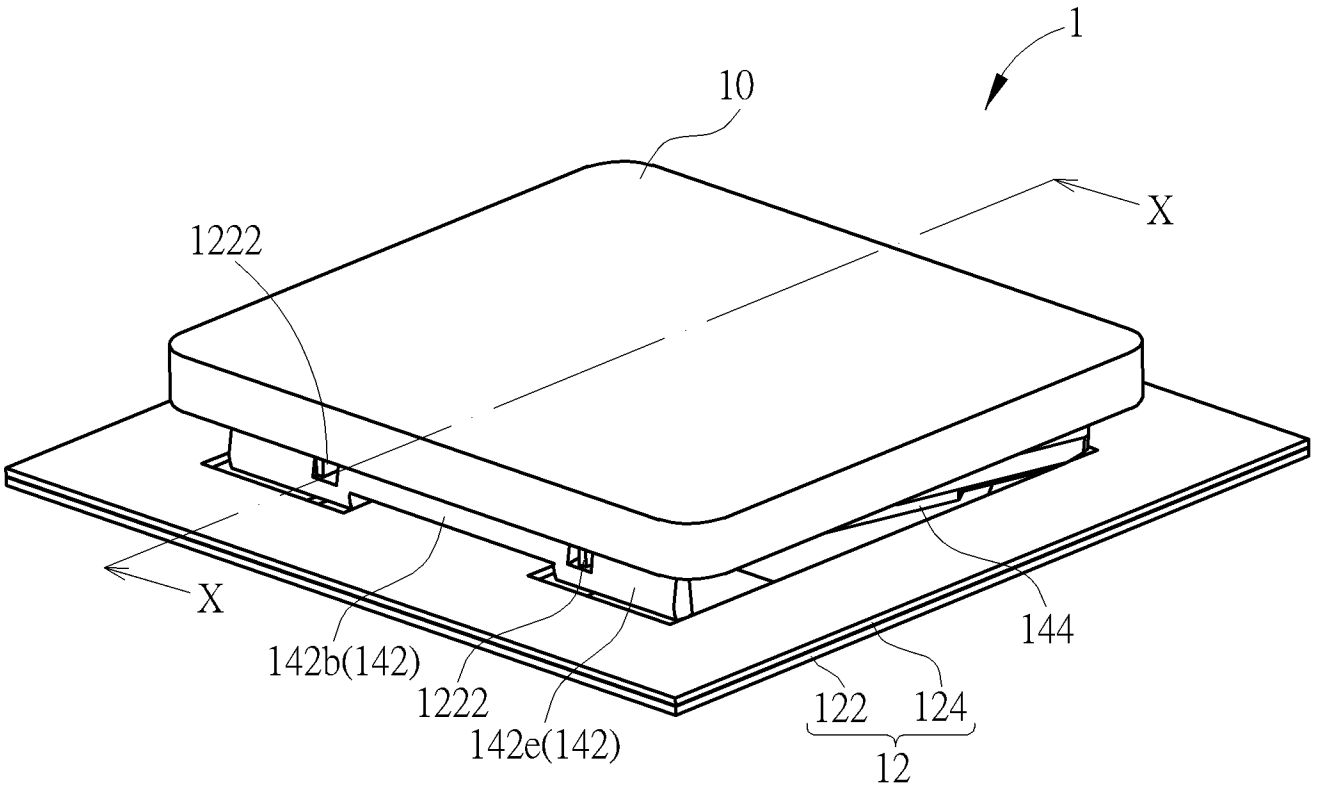
FIG. 1 is a schematic diagram illustrating a keyswitch structure according to a first embodiment.
Figure 2:
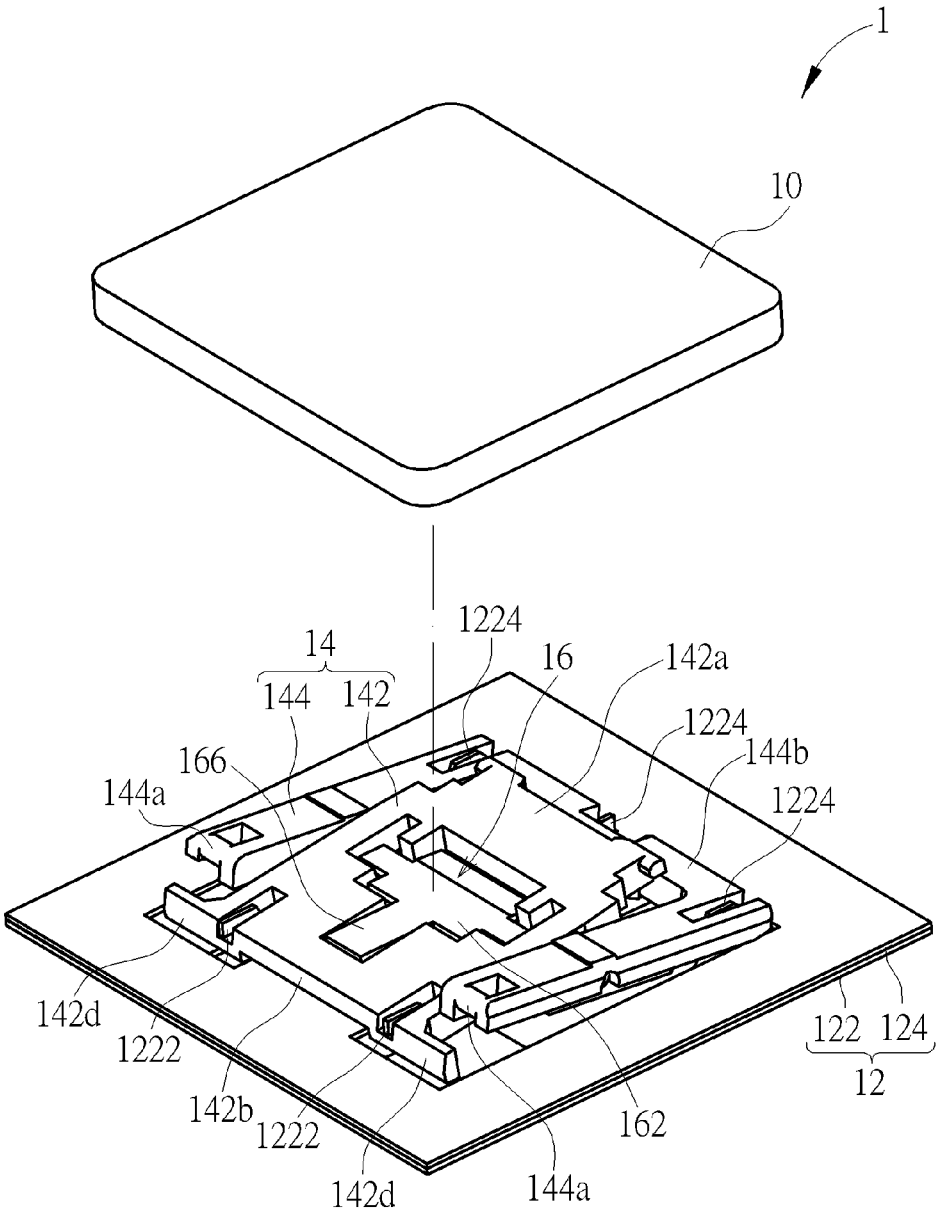
FIG. 2 is a partially exploded view of the keyswitch structure in FIG. 1.
Figure 3:
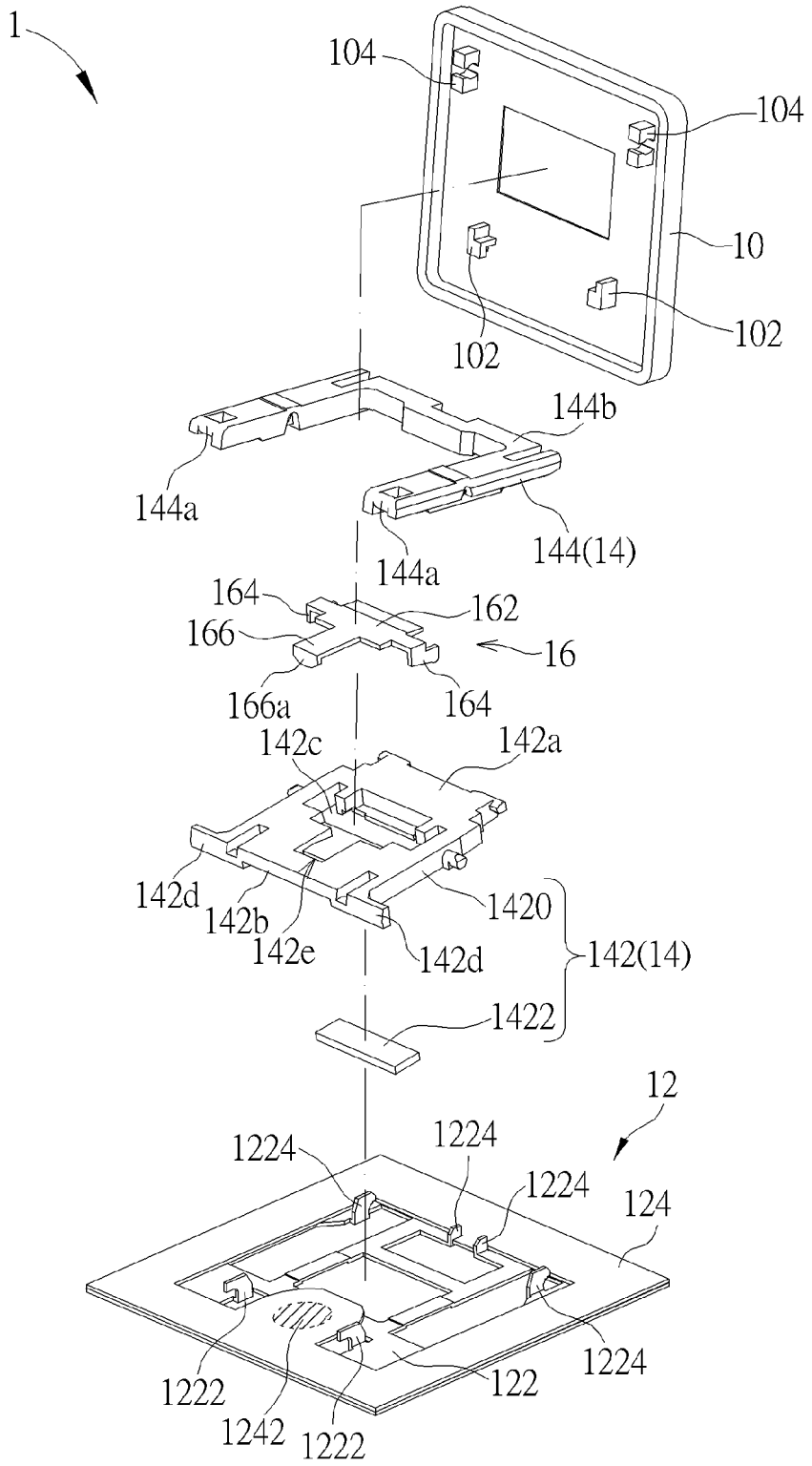
FIG. 3 is an exploded view of the keyswitch structure in FIG. 1.

Please refer to FIG. 1 to FIG. 3. A keyswitch structure 1 according to an embodiment includes a keycap 10, a base 12, a lift mechanism 14, and a third frame 16. The keycap 10 is disposed above the base 12. The lift mechanism 14 is connected to and between the keycap 10 and the base 12, so that the keycap 10 can move up and down relative to the base 12 through the lift mechanism 14. The third frame 16 is disposed between the keycap 10 and the base 12. The third frame 16 and the lift mechanism 14 interact with each other through a magnetic attraction force which is used for providing the keycap 10 with a driving force for moving back to its original position. Thereby, the keyswitch structure 1 can provide the keycap 10 with a return force without a conventional elastic member (e.g. a rubber dome), so that the lift mechanism 14 can obtain a relatively large space for the disposition, which is conducive to the structural strength and action stability of the lift mechanism 14.

Furthermore, the base 12 includes a base plate 122 and a circuit board 124 (e.g. a membrane circuit board) stacked on the base plate 122. The circuit board 124 has a switch 1242 (shown by dashed circles with hatching lines in FIG. 3). The lift mechanism 14 includes a first frame 142 and a second frame 144 which are disposed between the keycap 10 and the base 12. Two end portions 142*a* and 142*b* of the first frame 142 are rotatably connected to a connection portion 102 of the keycap 10 and a connection portion 1222 of the base plate 122 respectively. Two end portions 144*a* and 144*b* of the second frame 144 are rotatably connected to a connection portion 104 of the keycap 10 and a connection portion 1224 of the base plate 122 respectively. The first frame 142 and the second frame 144 are pivotally connected and form a scissors structure, so that the keycap 10 is supported on the first frame 142 and the second frame 144 and can move up and down relative to the base 12 through the first frame 142 and the second frame 144. The first frame 142 includes a first magnetic portion 1422. The third frame 16 includes a second magnetic portion 162, a supporting portion 164, and an extending arm 166, which are interconnected. The third frame 16 uses a through hole 142*c* of the first frame 142 to make the supporting portion 164 protrudes downward through the through hole 142*c*, so that the third frame 16 is supported on the base 12 (or the base plate 122) through the supporting portion 164. The second magnetic portion 162 is located between the keycap 10 and the first magnetic portion 1422. The extending arm 166 is located between the keycap 10 and the first frame 142. In the embodiment, a frame body 1420 of the first frame 142 is a plastic part. The first magnetic portion 1422 is a magnet embedded in the frame body 1420. The whole third frame 16 is made of a magnetic material (which can be magnetized material or magnetizable material), so the second magnetic portion 162 and the first magnetic portion 1422 magnetism interact. In practice, the first magnetic portion 1422 can be made of magnetic material while the second magnetic portion 162 can be realized by a magnet. For example, the whole third frame 16 is provided with a main body made of a metal plate and a magnet as the second magnetic portion 162 attached to the main body. Furthermore, the magnetic portions 1422 and 162 respectively are not limited to homogeneous material or structure. It is practicable to use a composite structure to form the magnetic portions 1422 and 162. In addition, in the embodiment, the end portion 142*b* of the first frame 142 protrudes outward along a rotation axis (substantially equal to the axis about which the first frame 142 and the connection portion 1222 relatively rotate) to form a protruding post 142*d* at the portion where the end portion 142*b* and the connection portion 1222 are connected, which can enhance the rotation stability of the first frame 142 relative to the connection portion 1222.

Figure 4:
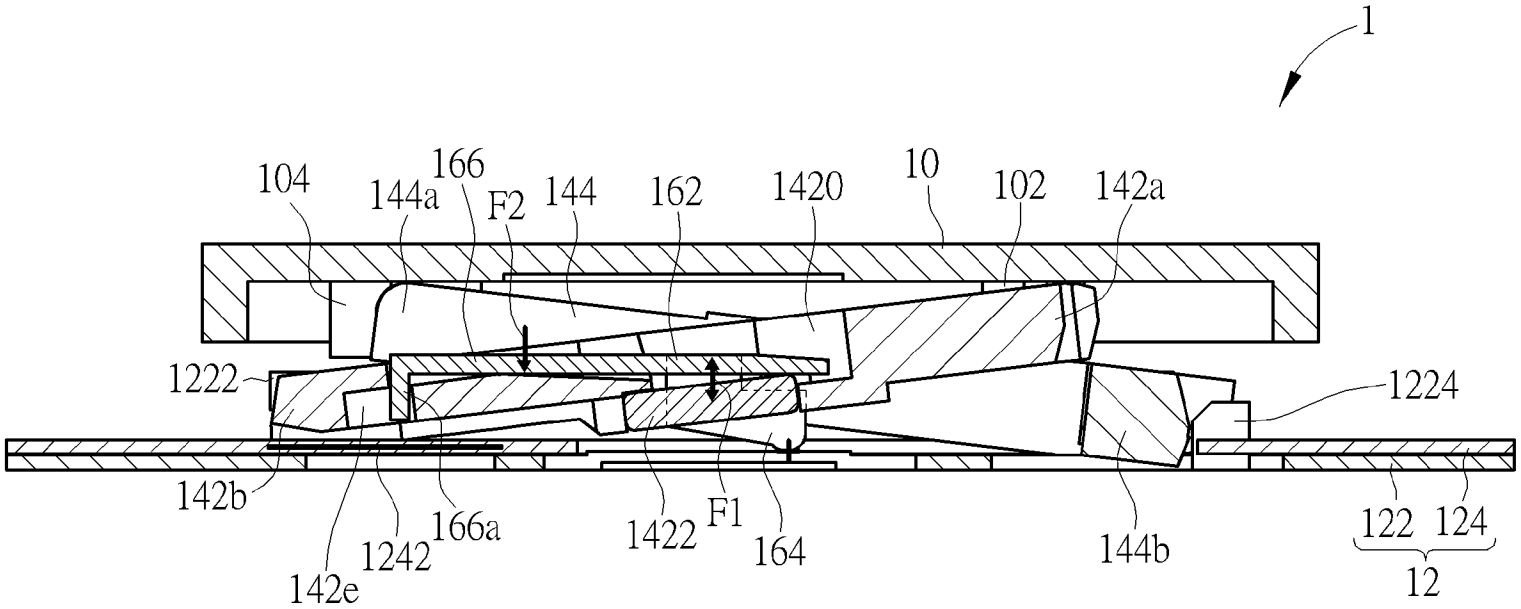
FIG. 4 is a sectional view of the keyswitch structure in FIG. 1 along the line X-X when a keycap thereof is not pressed with an external force yet and is located at an initial position.
Figure 5:
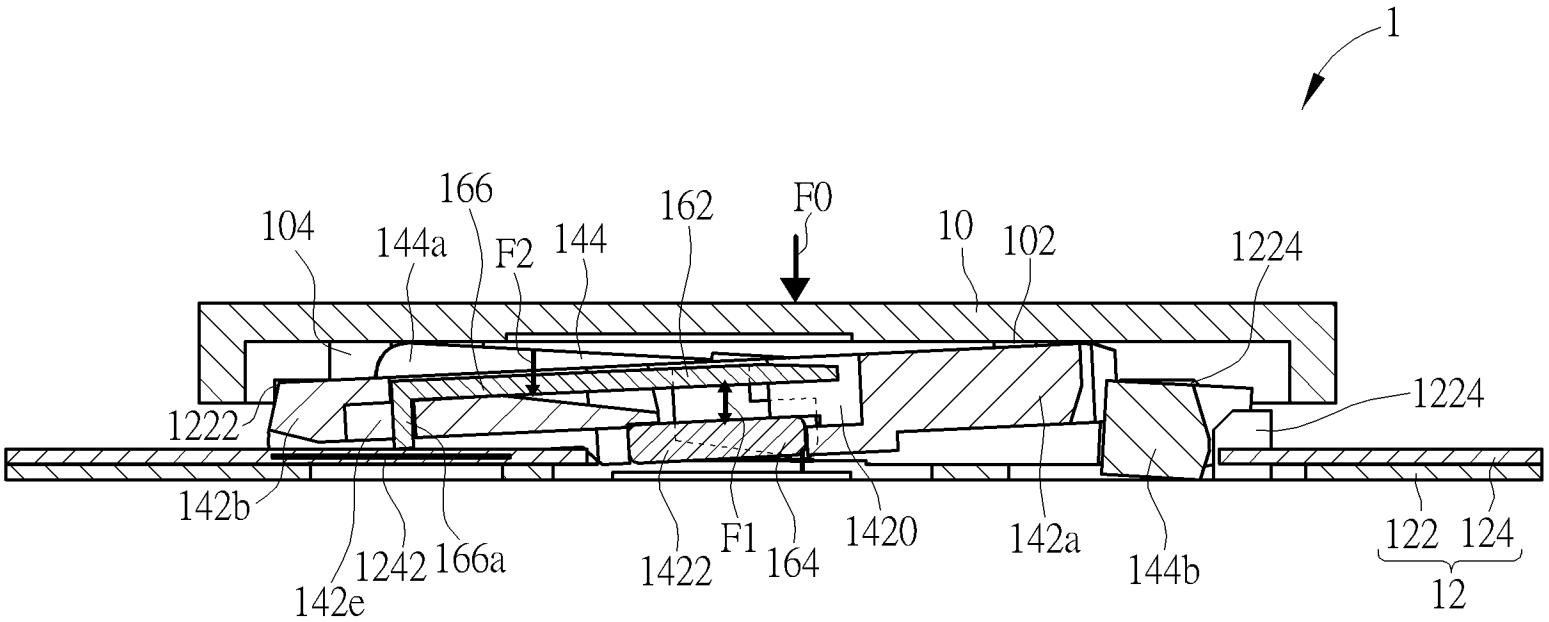
FIG. 5 is a sectional view of the keyswitch structure in FIG. 1 along the line X-X when the keycap is pressed with the external force to move to a triggering position.
Figure 6:
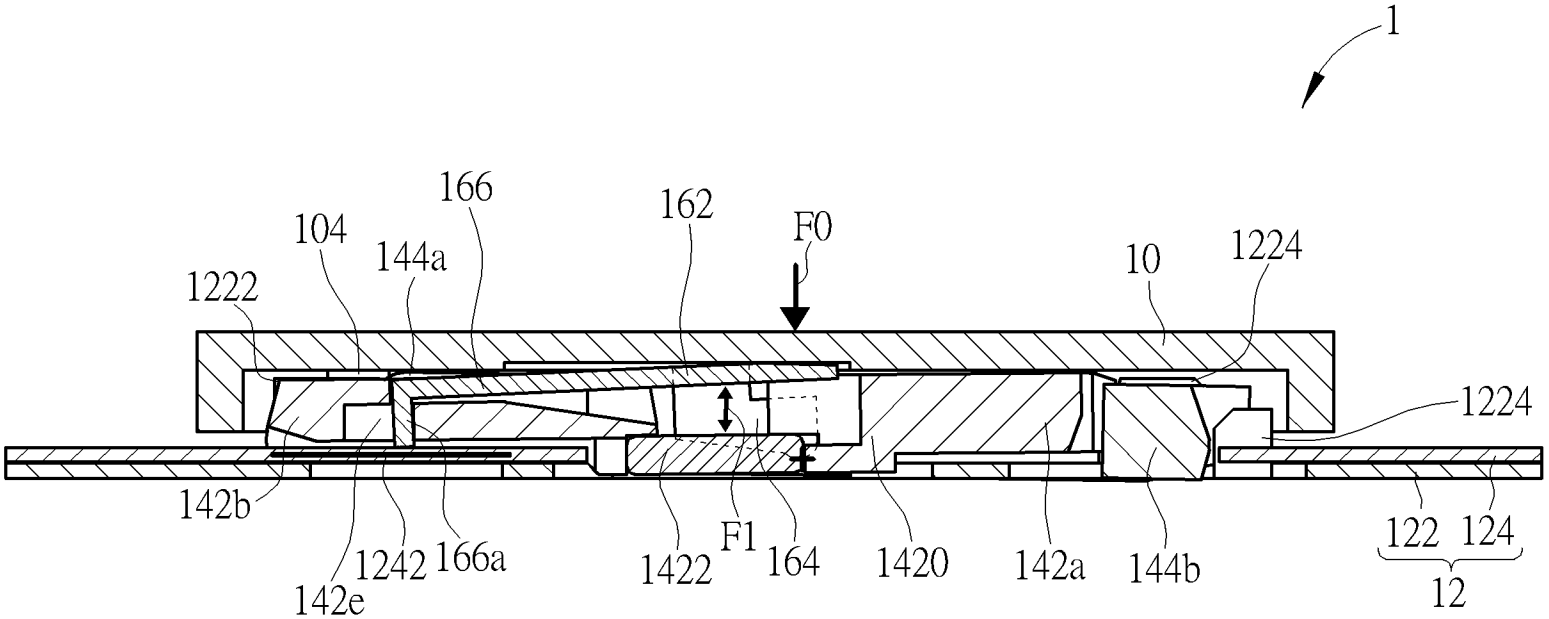
FIG. 6 is a sectional view of the keyswitch structure in FIG. 1 along the line X-X when the keycap is pressed with the external force to move to a pressed position.

Please also refer to FIG. 4 to FIG. 6; therein, the hidden profile of the supporting portion 164 is shown by dashed lines in the figures. In the keyswitch structure 1, when receiving an external force F0 (indicated by an arrow in the figures) to move toward the base 12, the keycap 10 moves from an initial position (equal to the position at which the keycap 10 is not pressed yet, as shown by FIG. 4) through a triggering position (as shown by FIG. 5) to a pressed position (as shown by FIG. 6). The second magnetic portion 162 and the first magnetic portion 1422 are oppositely disposed and form a magnetic attraction force F1 (indicated by a double arrow in the figures), so that the second magnetic portion 162 and the first magnetic portion 1422 have a tendency to approach each other. When the keycap 10 is not pressed with the external force F0, the magnetic attraction force F1 drives the first magnetic portion 1422 and the second magnetic portion 162 to approach each other, so that the keycap 10 moves from the pressed position through the triggering position back to the initial position and then the first frame 142 and the third frame 16 are supported on the base 12 stably. In the embodiment, although the first magnetic portion 1422 and the second magnetic portion 162 cannot closely contact each other due to the actual structural configuration, the magnetic attraction force F1 still can make the first frame 142 and the third frame 16 be joined stably. In practice, it is practicable to closely contact the first magnetic portion 1422 with the second magnetic portion 162 by modifying the structural configuration thereof, which can enhance the stability of the joining of the first frame 142 with the third frame 16 due to the magnetic attraction force F1. For the mechanical logic, the first frame 142 and the third frame 16 perform a temporarily fixedly connected structure by the attraction effect of the first magnetic portion 1422 with the second magnetic portion 162. The first frame 142 is connected to the base plate 122 through the end portion 142*b*. The third frame 16 abuts against the base plate 122 through the supporting portion 164. Thereby, the first frame 142 and the third frame 16 form a structure of which the status is fixed, so as to be supported on the base 12 stably. When the keycap 10 is pressed with the external force F0 to move toward the base 12 (e.g. the user presses the keycap 10 by finger), the first frame 142 rotates toward the base 12 so that the first magnetic portion 1422 and the second magnetic portion 162 depart from each other. At the moment, the first frame 142 and the third frame 16 are no longer a fixedly connected structure and are relatively movable.

The extending arm 166 is placed on the first frame 142. The extending arm 166 has a triggering portion 166*a* capable of protruding downward through a through hole 142*e* of the first frame 142 (i.e. protruding toward the switch 1242), so that when the keycap 10 is pressed with the external force F0 to move toward the base 12, the triggering portion 166*a* can trigger the switch 1242. In the embodiment, the supporting portion 164 abuts against the base plate 122, so the abutting location can be considered as the rotation center of the third frame 16 relative to the base plate 122, i.e. a fulcrum thereof (indicated by a cross mark in the figures). Based on the projections of the extending arm 166, the second magnetic portion 162, and the fulcrum onto the base plate 122, the mass center of the second magnetic portion 162 is located between the mass center of the extending arm 166 and the fulcrum, so that the magnetic attraction force F1 will drive the supporting portion 164 to keep abutting against the base plate 122 in principle and the extending arm 166 keeps abutting against the first frame 142 in principle. In the view point of FIG. 4 to FIG. 6, in the process of the keycap 10 being pressed with the external force F0 to move toward the base plate 122 from the initial position through the triggering position to the pressed position, the first frame 142 clockwise rotates, and the first magnetic portion 1422 moves away from the second magnetic portion 162. The third frame 16 has a tendency to counterclockwise rotate under the magnetic attraction force F1. Before the triggering portion 166*a* triggers the switch 1242, the extending arm 166 keeps contacting the first frame 142. When the keycap 10 is located at the triggering position, the triggering portion 166*a* contacts and triggers the switch 1242. After the triggering portion 166*a* contacts the switch 1242, although the first frame 142 continues rotating as the keycap 10 moves downward, the third frame 16 no longer rotates in principle and the extending arm 166 and the first frame 142 depart from each other. When the keycap 10 moves from the triggering position to the pressed position, the triggering portion 166*a* keeps contacting the switch 1242. Furthermore, in the movement of the keycap 10 from the triggering position to the pressed position, the third frame 16 no longer rotates in principle, so the triggering force applied to the switch 1242 by the triggering portion 166*a* does not increase substantially (ignoring the effect on the triggering force due to the variation of the magnetic attraction force F1), which can protect the structure of the switch 1242 and prolong its service life. In addition, in the movement of the keycap 10 from the initial position to the triggering position, the extending arm 166 contacts and applies a force F2 (indicated by an arrow in the figures) to the first frame 142 under the magnetic attraction force F1, which facilitates the clockwise rotation of the first frame 142. When the keycap 10 is not pressed with the external force F0 (e.g. the user removes his finger away from the keycap 10), the magnetic attraction force F1 drives the first magnetic portion 1422 and the second magnetic portion 162 to approach each other, so that the first frame 142 and the third frame 16 contact each other and are supported on the base 12 stably (as shown by FIG. 4). Therein, the magnetic attraction force F1 drives the first frame 142 to counterclockwise rotate and simultaneously drives the third frame 16 to clockwise rotate, so that the keycap 10 moves from the pressed position through the triggering position back to the initial position.

In the embodiment, when the keycap 10 reaches the triggering position, the triggering portion 166*a* triggers the switch 1242, so the keyswitch structure 1 can provide a two-stage pressing manipulation, which is conducive to variety of inputting by the keyswitch structure 1 (e.g. the keyswitch structure 1 has another triggering portion for triggering another switch of the circuit board 124 when the keycap 10 reaches the pressed position). However, the invention is not limited thereto. For example, the triggering position and the pressed position can coincide by designing the length of the triggering portion 166*a* protruding out of the first frame 142 or the location of the switch 1242 (or the triggering portion 166*a*); in this case, the keycap 10 has only two statuses (i.e. pressed or not pressed).

Figure 7:
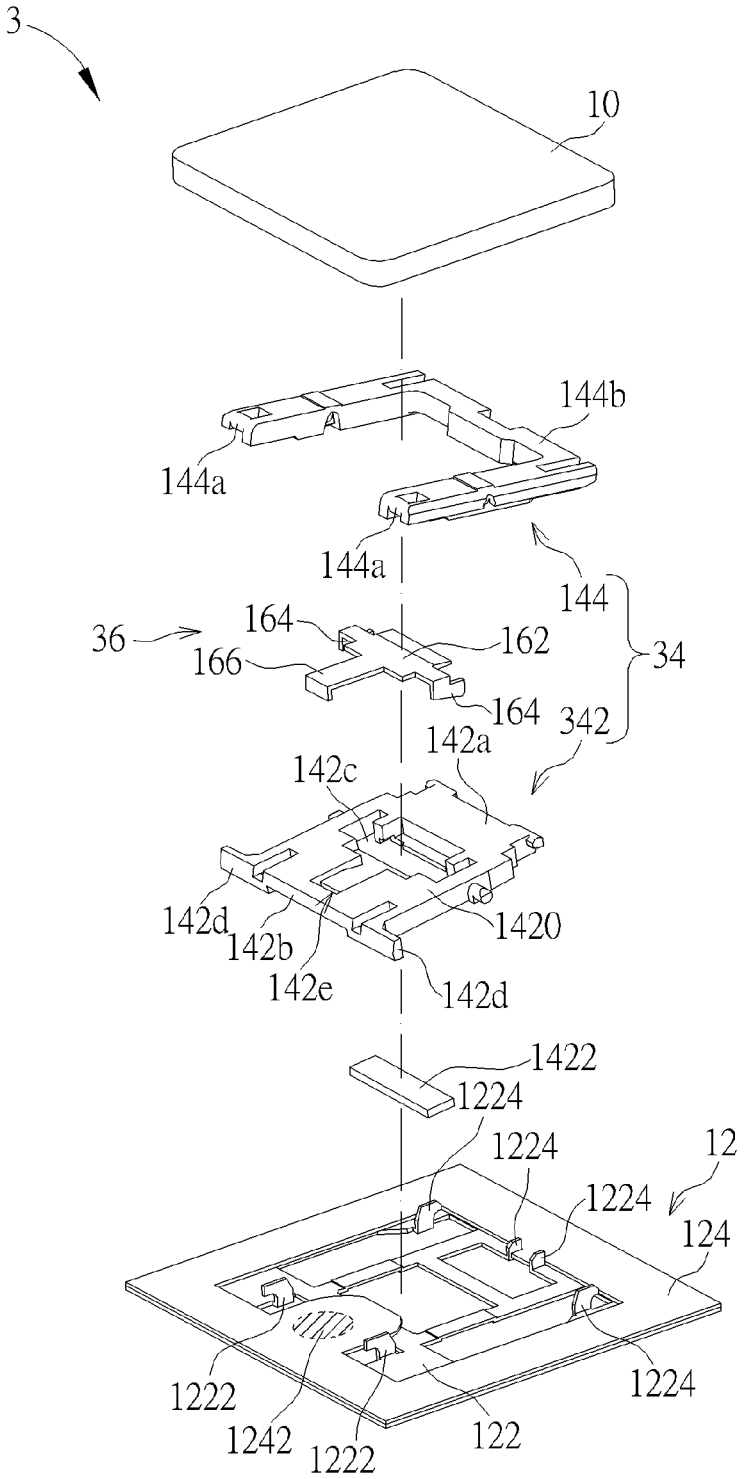
FIG. 7 is an exploded view of a keyswitch structure according to a second embodiment.
Figure 8:
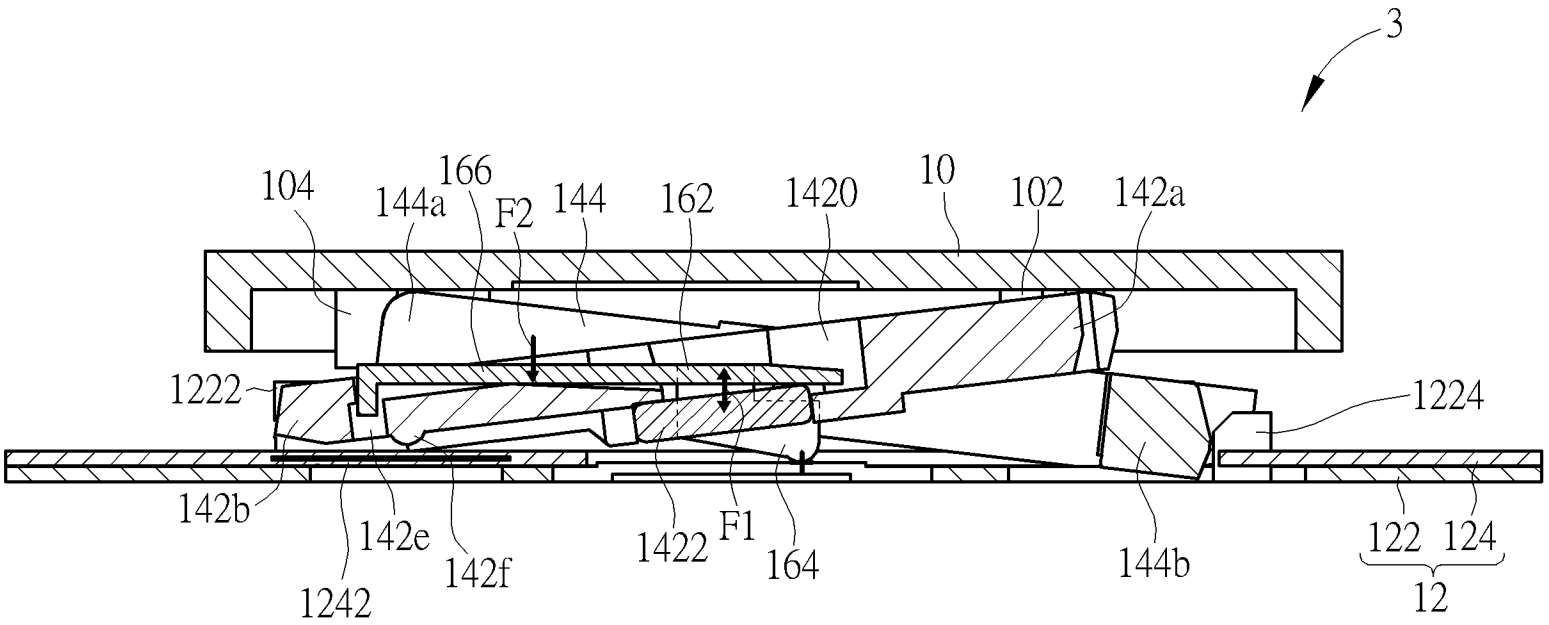
FIG. 8 is a sectional view of the keyswitch structure in FIG. 7 when a keycap thereof is not pressed with an external force yet.
Figure 9:
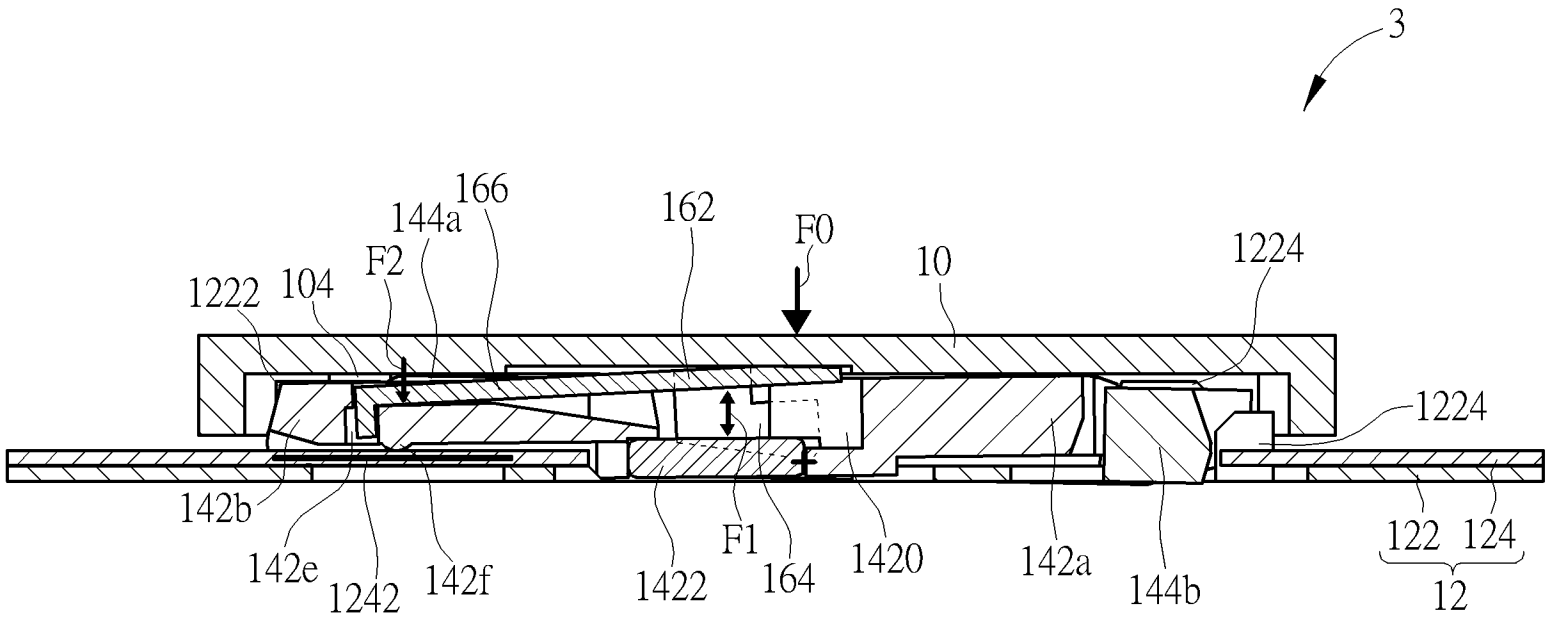
FIG. 9 is a sectional view of the keyswitch structure in FIG. 7 when the keycap is pressed with the external force yet.

Please refer to FIG. 7 to FIG. 9; therein, the cutting planes of FIG. 8 and FIG. 9 can refer to the line X-X in FIG. 1, and the hidden profile of the supporting portion 164 is shown by dashed lines in the figures. The keyswitch structure 3 is substantially similar in structure to the keyswitch structure 1. The keyswitch structure 3 uses the reference numbers used in the keyswitch structure 1. For descriptions about components of the keyswitch structure 3, please refer to the descriptions about the components with the same names in the keyswitch structure 1. A difference between the keyswitch structure 3 and the keyswitch structure 1 is that a third frame 36 of the keyswitch structure 3 no longer takes charge of triggering the switch 1242 while the switch 1242 is triggered by a first frame 342 of a lift mechanism 34 of the keyswitch structure 3. The first frame 342 includes a triggering portion 142*f* corresponding to the switch 1242. The triggering portion 142*f* protrudes from the frame body 1420 toward the switch 1242. When the keycap 10 is pressed with the external force F0 to move toward the base 12, the triggering portion 142*f* triggers the switch 1242. In the embodiment, the keycap 10 has only two positions. One is the initial position (i.e. the keycap 10 is not pressed); the other is the pressed position and the triggering position as well (i.e. the keycap 10 is pressed). In addition, in the embodiment, the third frame 36 still has the extending arm 166, so when the keycap 10 moves from the initial position to the pressed position (or the triggering position), the extending arm 166 keeps contacting and applying a force F2 (indicated by an arrow in the figures) to the first frame 342 under the magnetic attraction force F1, which is also conducive to the clockwise rotation of the first frame 342.

Figure 10:
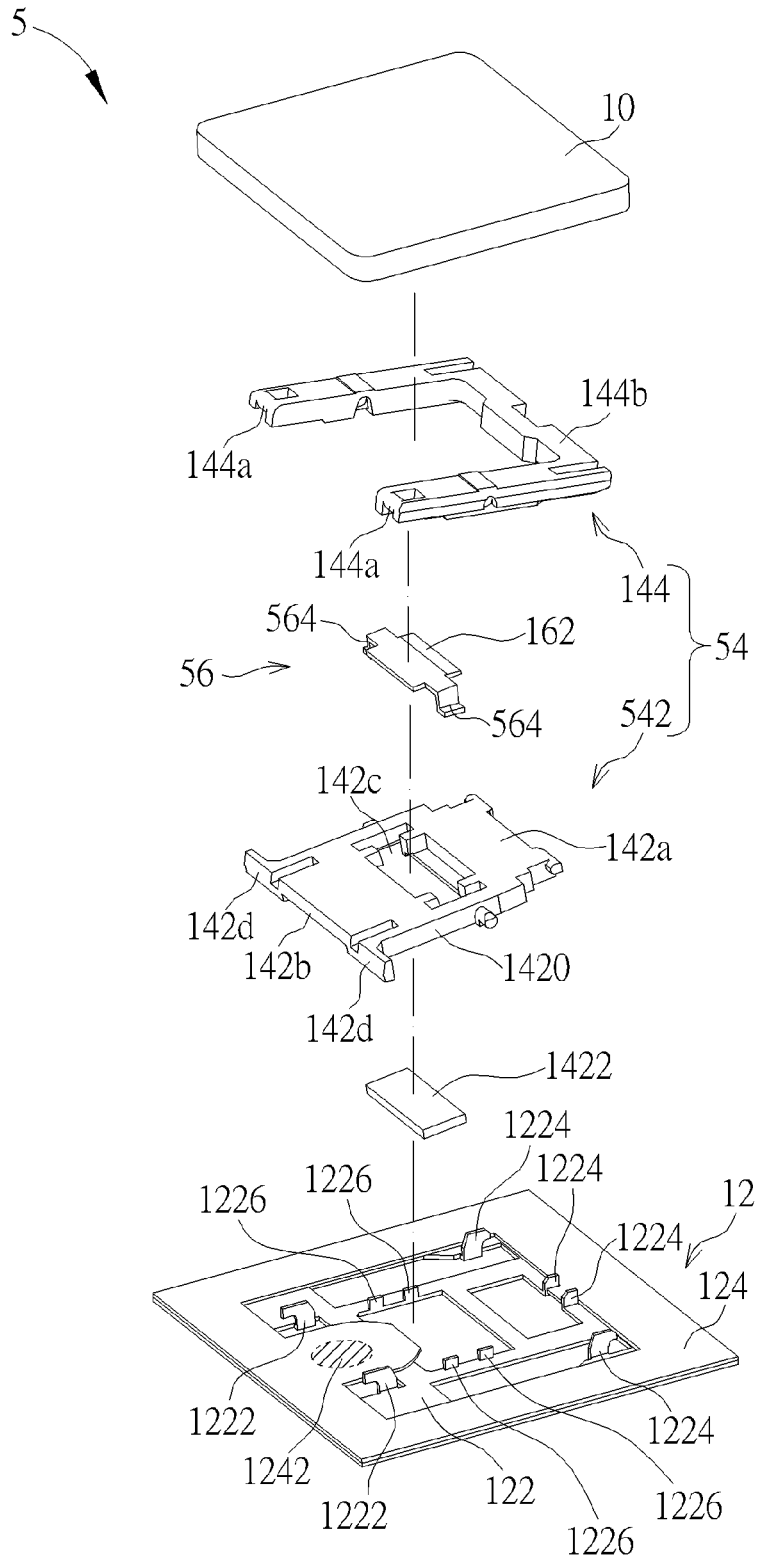
FIG. 10 is an exploded view of a keyswitch structure according to a third embodiment.
Figure 11:
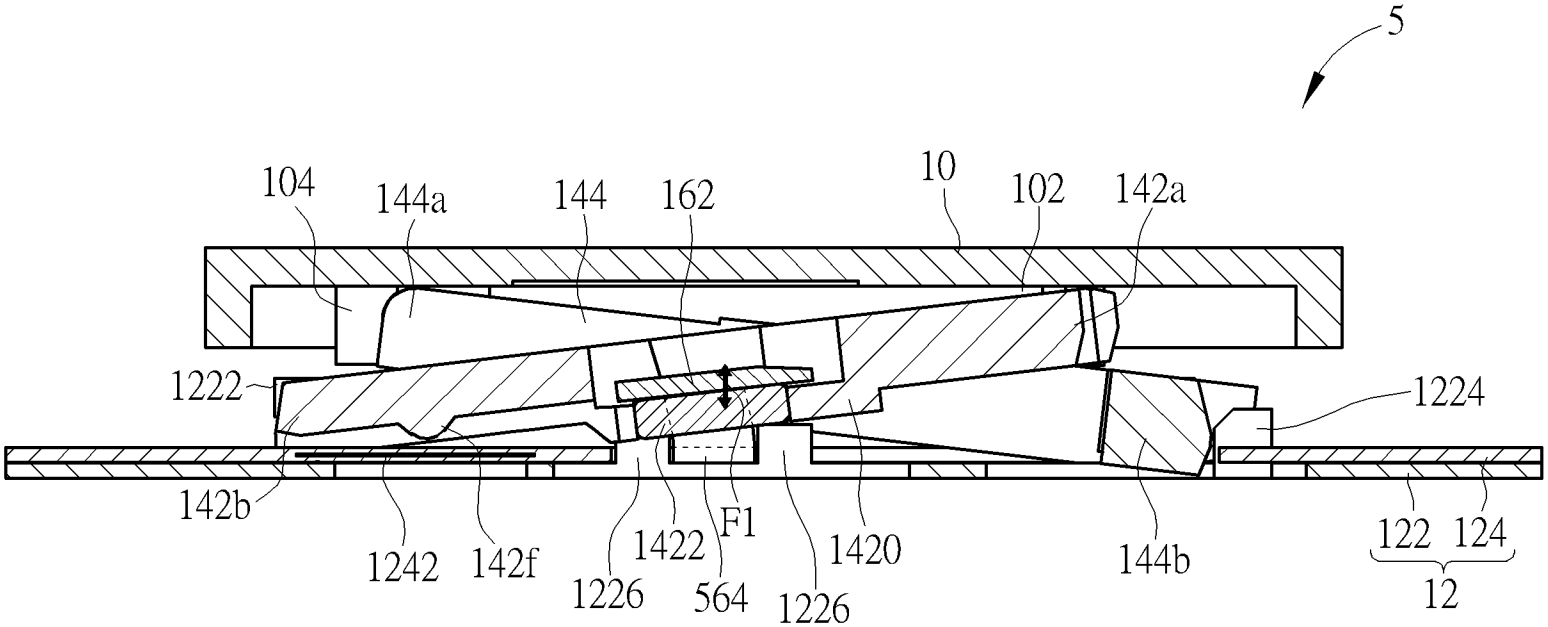
FIG. 11 is a sectional view of the keyswitch structure in FIG. 10 when a keycap thereof is not pressed with an external force yet.
Figure 12:
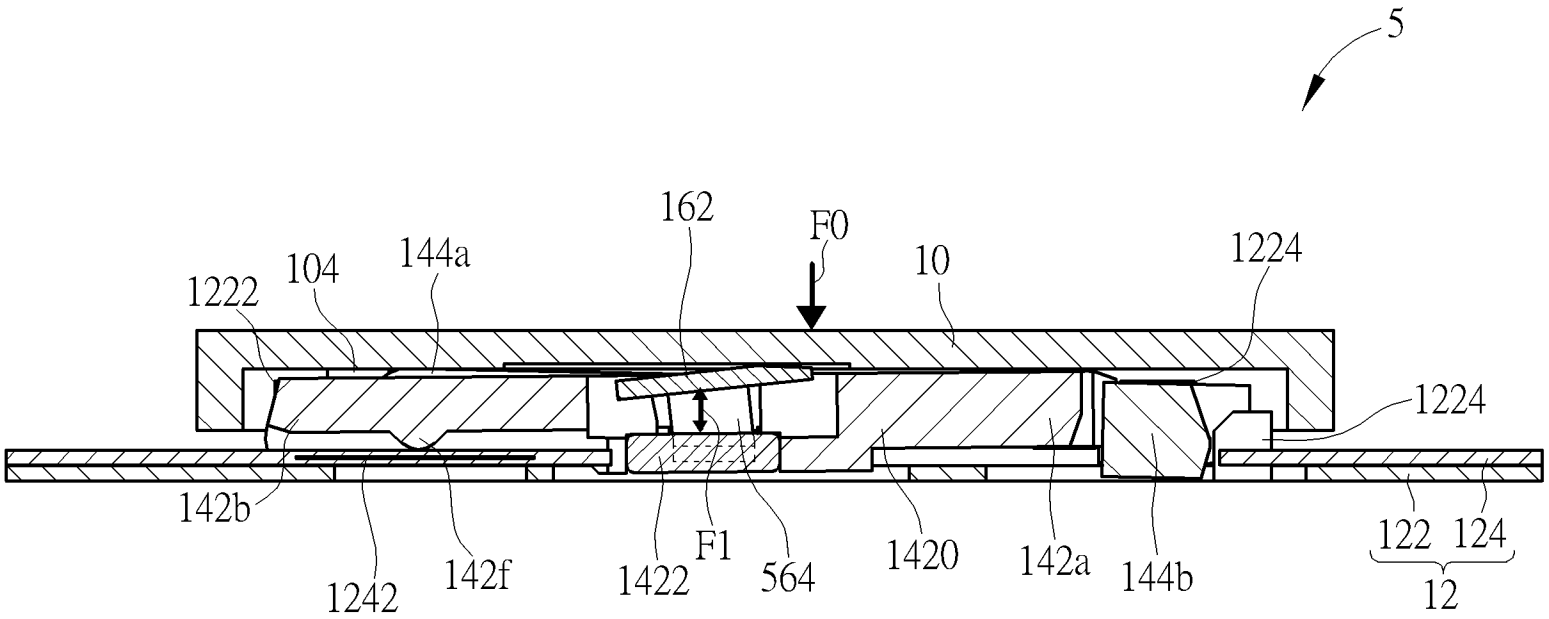
FIG. 12 is a sectional view of the keyswitch structure in FIG. 10 when the keycap is pressed with the external force yet.

Please refer to FIG. 10 to FIG. 12; therein, the cutting planes of FIG. 8 and FIG. 9 can refer to the line X-X in FIG. 1. The keyswitch structure 5 is substantially similar in structure to the keyswitch structure 3. The keyswitch structure 5 uses the reference numbers used in the keyswitch structure 3. For descriptions about components of the keyswitch structure 5, please refer to the descriptions about the components with the same names in the keyswitch structure 3. A difference between the keyswitch structure 5 and the keyswitch structure 3 is that in addition to not taking charge of triggering the switch 1242, a third frame 56 of the keyswitch structure 5 does not include the extending arm 166. Hence, a first frame 542 of a lift mechanism 54 of the keyswitch structure 5 interacts only with the second magnetic portion 162 of the third frame 56; therein, the hidden profile of a supporting portion 564 is shown by dashed lines in FIG. 11 and FIG. 12. Similarly, the third frame 56 still can provide a return force to the keycap 10 by the magnetic attraction force F1 produced by and between the second magnetic portion 162 and the first magnetic portion 1422; besides, the third frame 56 and the first frame 542 form a stable supporting structure on the base 12 when the keycap 10 is not pressed yet. Furthermore, in the embodiment, the third frame 56 need not move as the keycap 10 move relative to the base 12. The third frame 56 is fixed on the base plate 122 through the supporting portion 564; therein, the supporting portion 564 is wedged between protruding posts 1226 of the base plate 122. However, the invention is not limited thereto. For example, the third frame 56 can be rotatably connected onto the base plate 122, like the supporting portions 164 of the third frames 16 and 36 abutting against the base plate 122.

In the above embodiments, the third frames 16 and 36 are illustrated with the supporting portion 164 abutting against the base plate 122, but the invention is not limited thereto. In principle, as long as the third frames 16 and 36 are rotatably supported on the base 12, not limited to abutting connection, the magnetic attraction force F1 can drive the extending arm 166 to apply a force toward the base 12 to the first frames 142 and 342 when the keycap 10 is pressed with the external force F0 to move toward the base 12. For example, the above rotatable connection can be realized by a pivotal connection or by a connection structure or material capable of elastically bending for connecting the third frames 16 and 36 with the base plate 122, so that the third frames 16 and 36 can rotate relative to the base 12.

Figure 13:
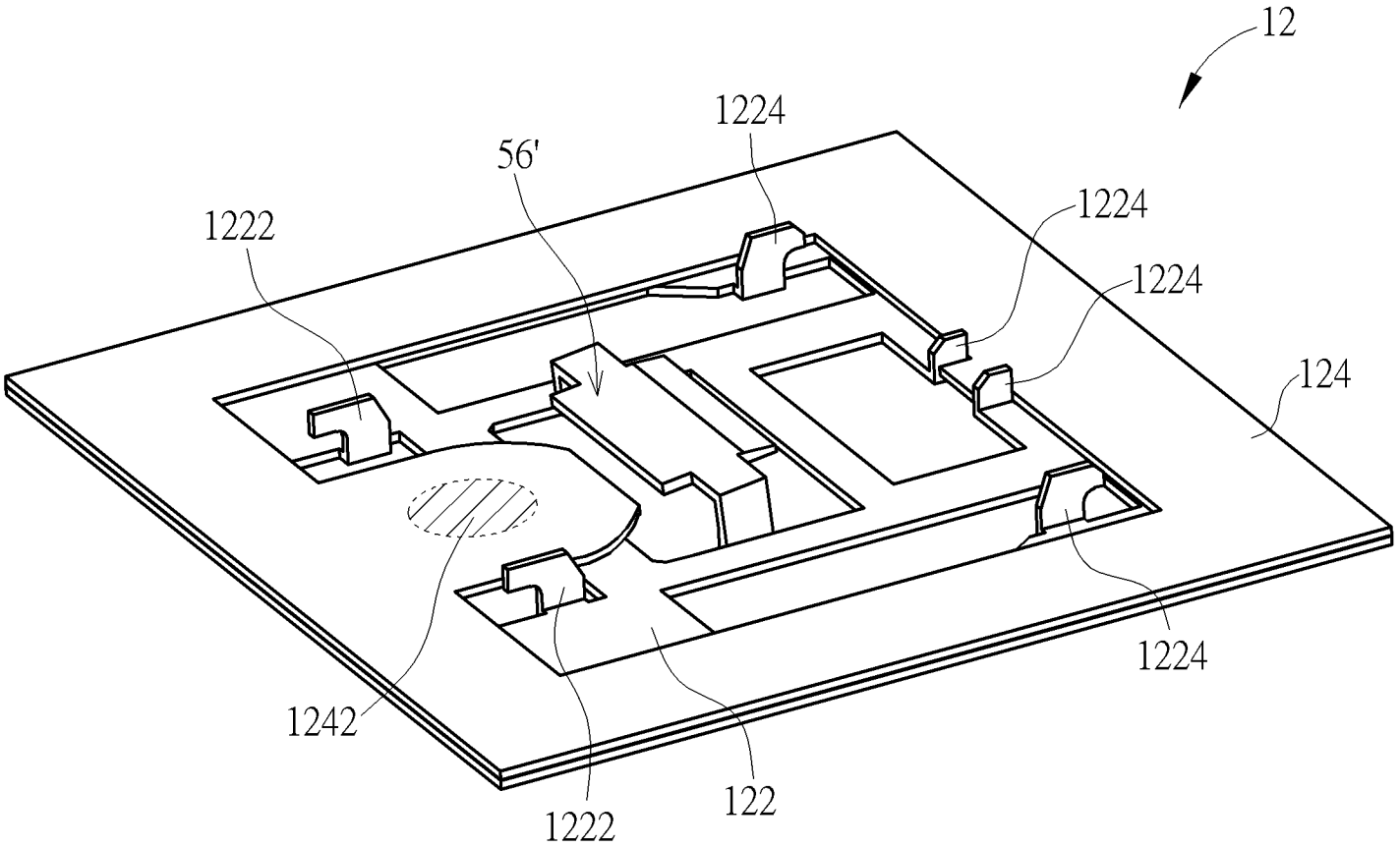
FIG. 13 is a schematic diagram illustrating the assembly combination of a base plate with a third frame according to another embodiment.

In addition, if the third frame (e.g. the third frames 36 and 56) need not to trigger the switch 1242, the third frame need not rotate as the keycap 10 move up and down. In other words, the third frame can be fixedly disposed relatively to the base 12, for example by adhering onto the base 12 (or the base plate 122) or by protruding upward a portion of the base plate 122 to directly form the third frame (e.g. by stamping a metal plate to form the base plate 122 and the third frame 56' at the same time, as shown by FIG. 13).

Figure 14:
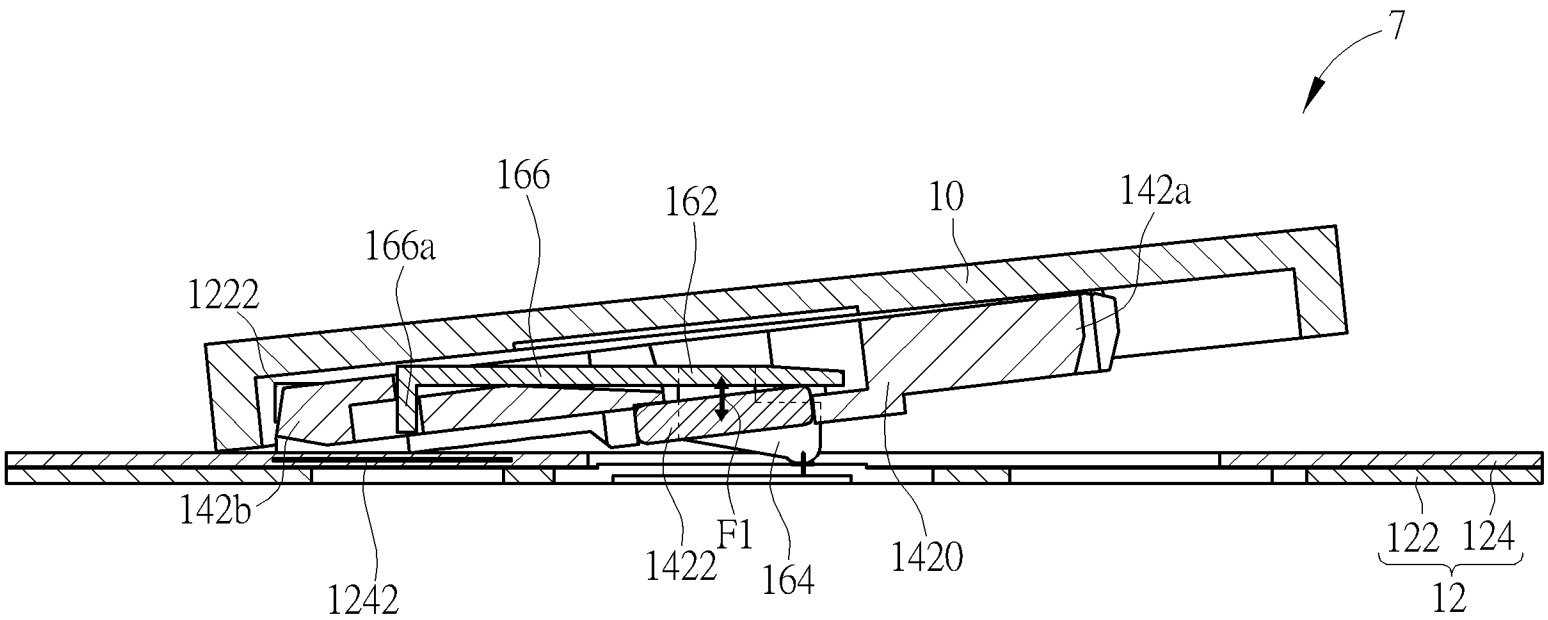
FIG. 14 is a sectional view of a keyswitch structure according to a fourth embodiment when a keycap thereof is not pressed with an external force yet and is be located at an initial position.
Figure 15:
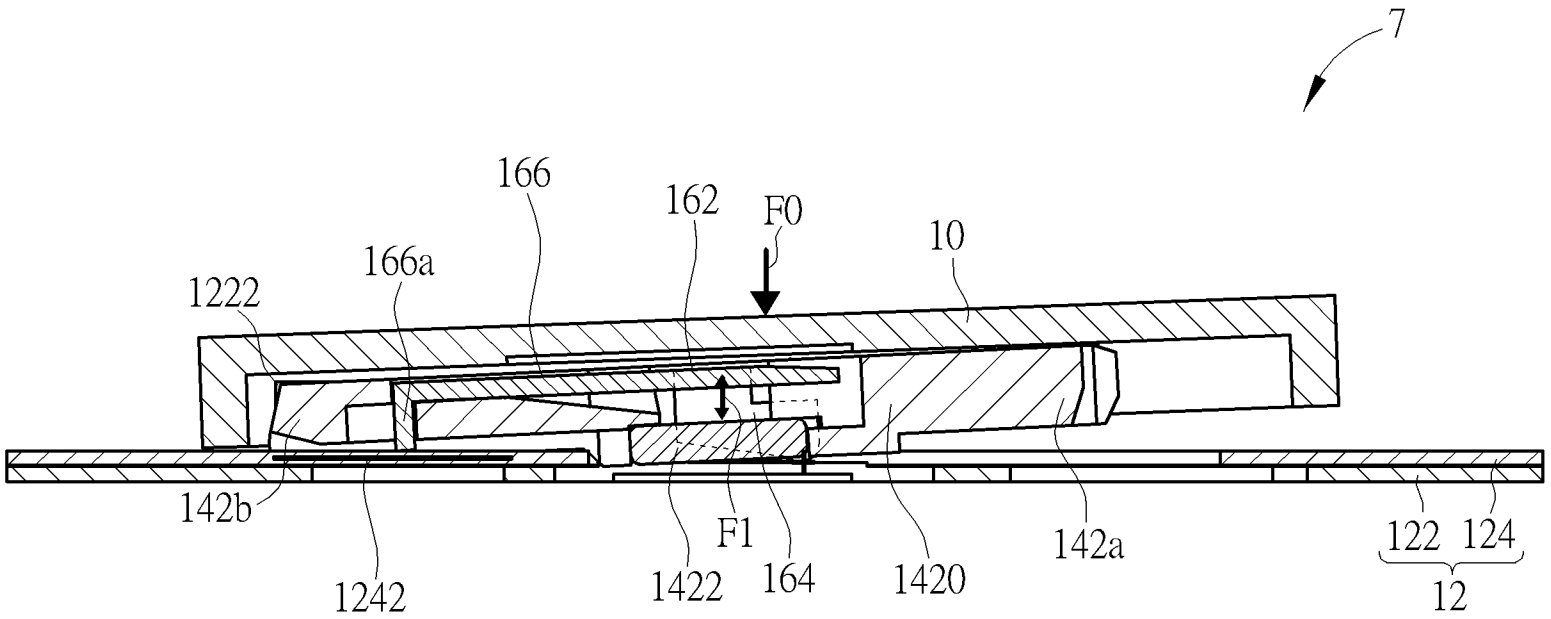
FIG. 15 is a sectional view of the keyswitch structure in FIG. 14 when the keycap is pressed with the external force to move to a triggering position.
Figure 16:
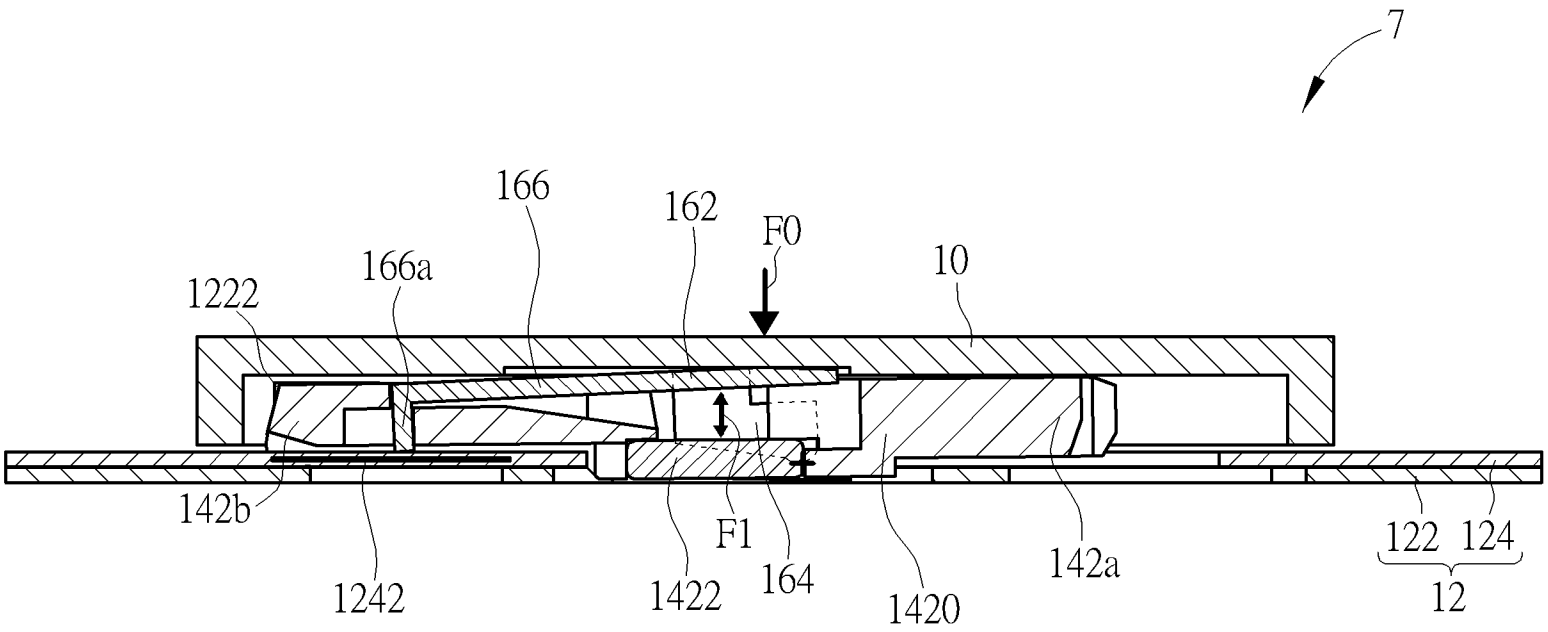
FIG. 16 is a sectional view of the keyswitch structure in FIG. 14 when the keycap is pressed with the external force to move to a pressed position.
Figure 17:
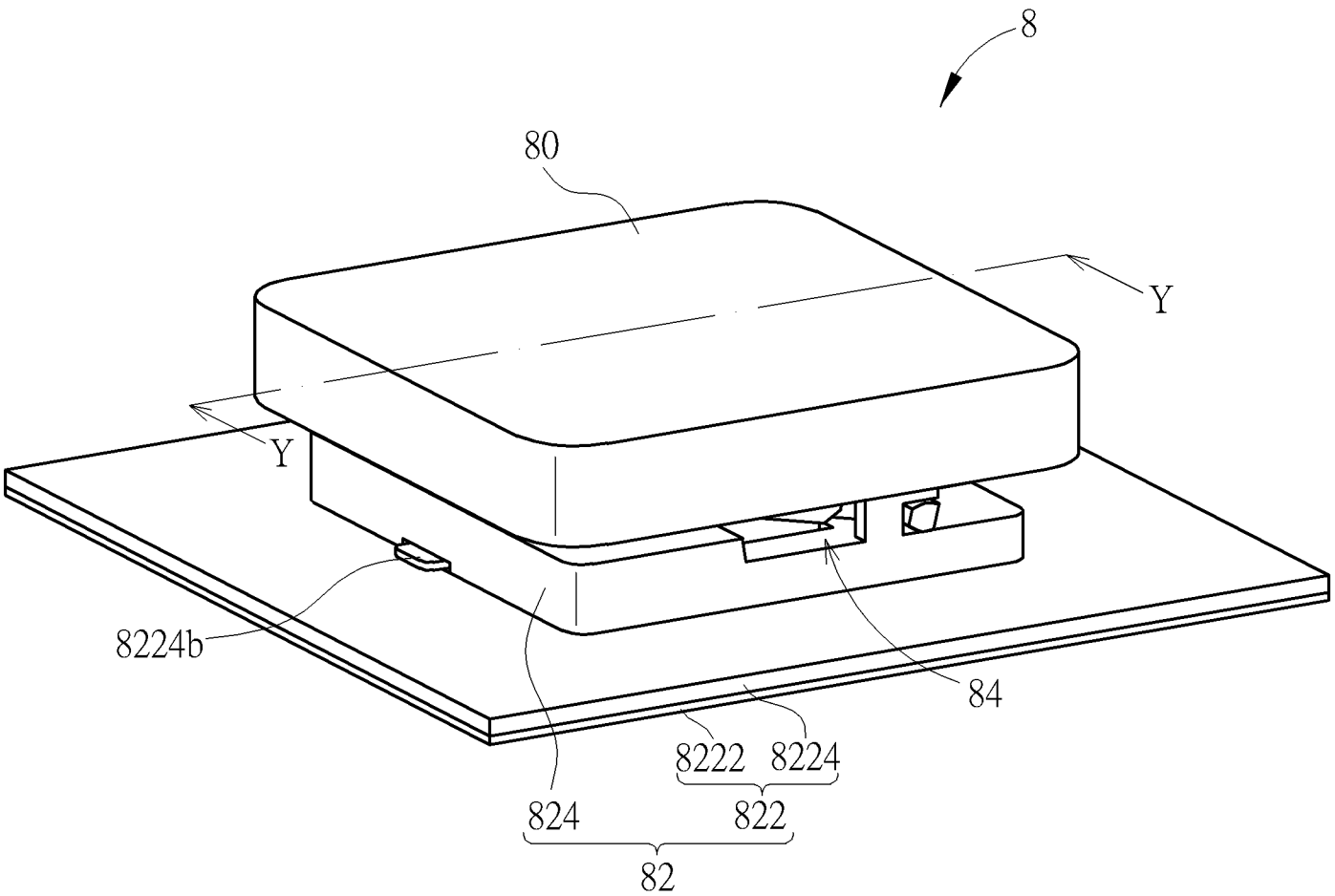
FIG. 17 is a schematic diagram illustrating a keyswitch structure according to a first embodiment.
Figure 18:
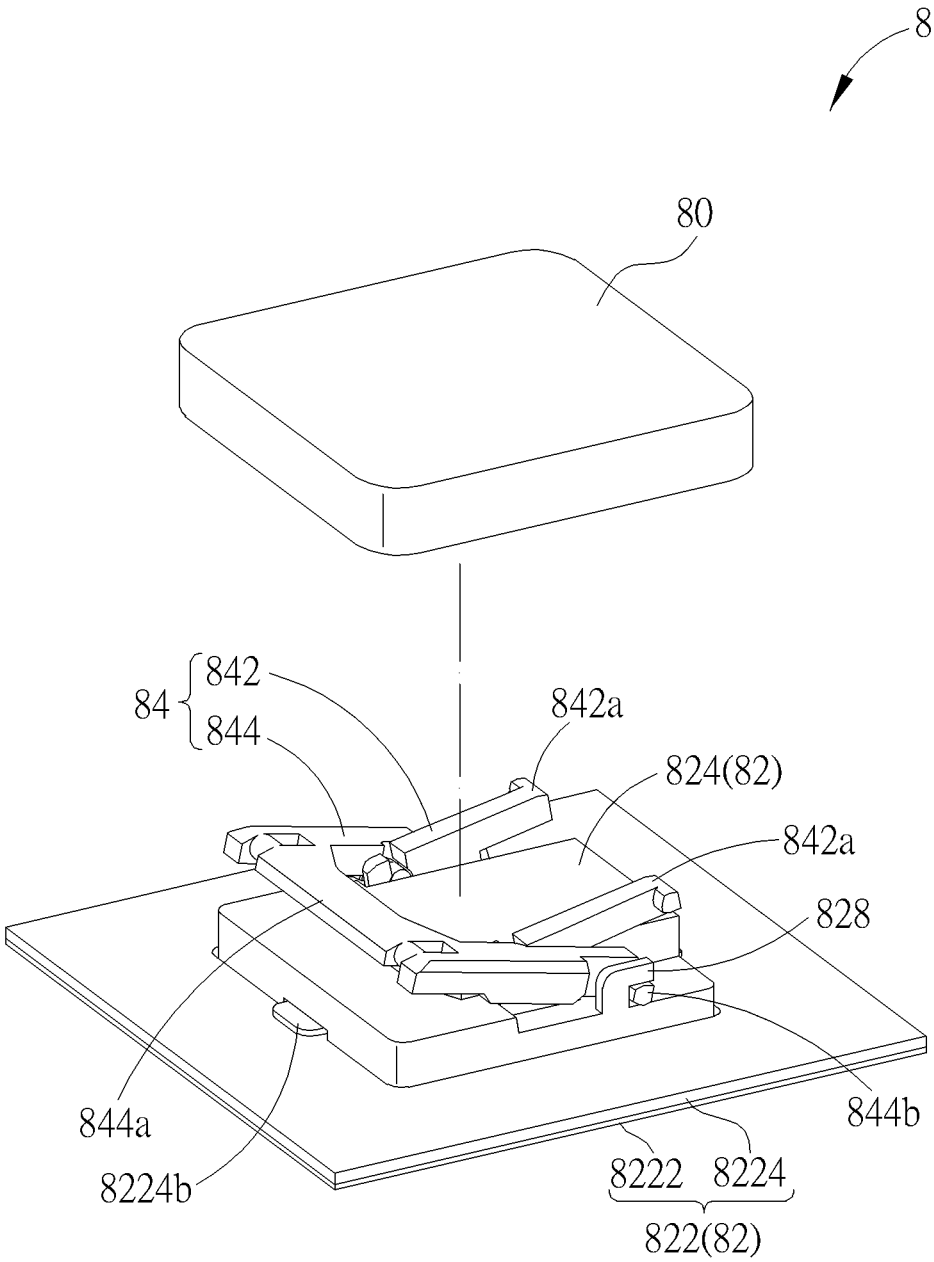
FIG. 18 is a partially exploded view of the keyswitch structure in FIG. 17.
Figure 19:
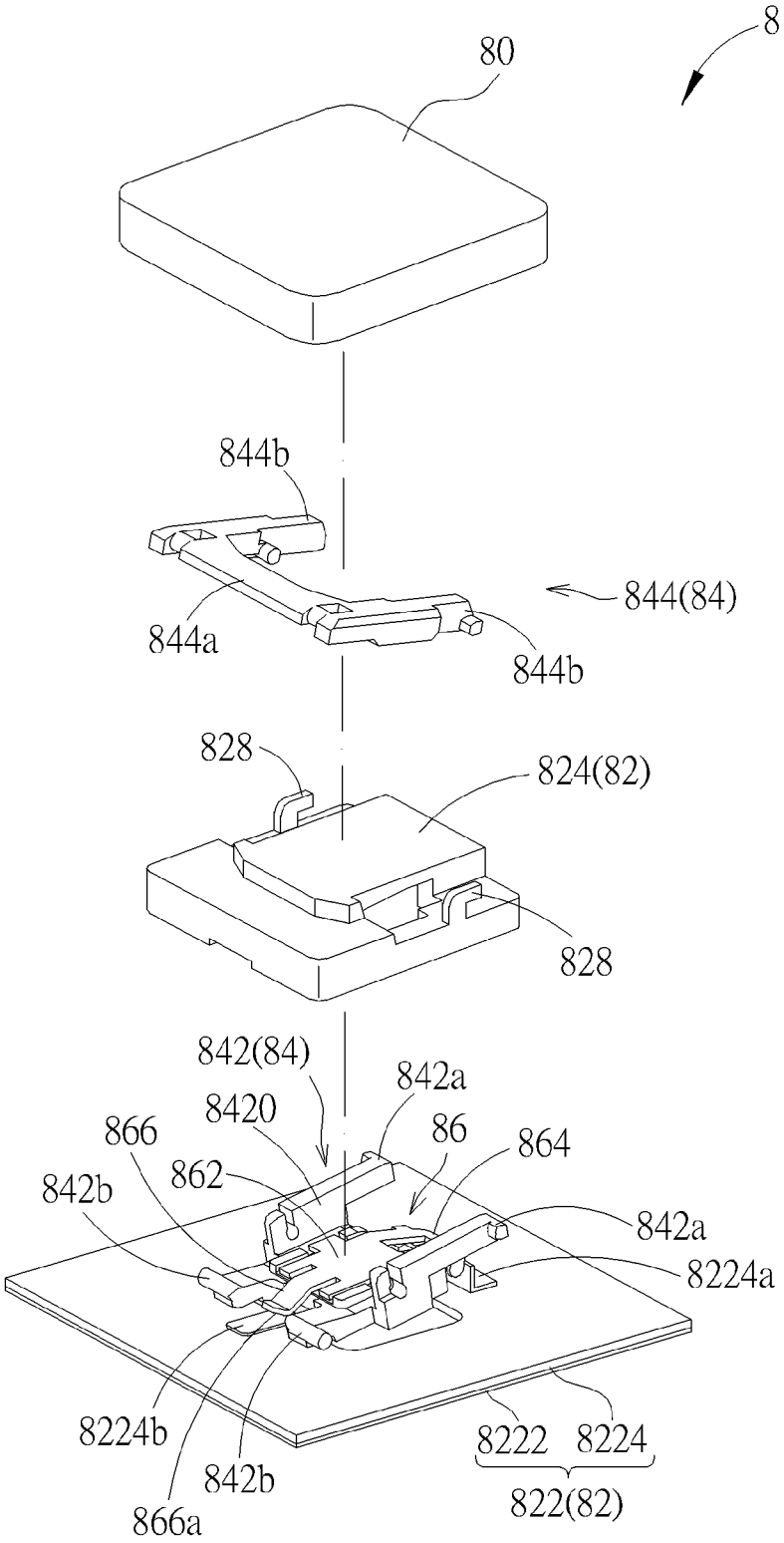
FIG. 19 is another partially exploded view of the keyswitch structure in FIG. 17.

In addition, in the above embodiments, the keycap 10 is horizontally supported on the base 12 through the first frame 142 and the second frame 144, but the invention is not limited thereto. In practice, the up and down movement of the keycap 10 relative to the base 12 is not limited to levelly moving. The keycap 10 also can have different positions relative to the base 12 through an up and down swing, so the up and down swing of the keycap 10 can be considered to be an up and down movement relative to the base 12 in logic. Please refer to FIG. 14 to FIG. 16; therein, the cutting planes of FIG. 14 to FIG. 16 can refer to the line X-X in FIG. 1, and the hidden profile of the supporting portion 164 are shown in dashed lines in the figures. The keyswitch structure 7 is substantially similar in structure to the keyswitch structure 1. The keyswitch structure 7 uses the reference numbers used in the keyswitch structure 1. For descriptions about components of the keyswitch structure 7, please refer to the descriptions about the components with the same names in the keyswitch structure 1. A difference between the keyswitch structure 7 and the keyswitch structure 1 is that the keyswitch structure 7 only uses the first frame 142 as a lift mechanism thereof. The end portion 142*a* of the first frame 142 is connected to a side of the keycap 10. Another side of the keycap 10 is slidably placed on the base 12 directly. In other words, the keycap 10 is supported on the first frame 142 and can swing up and down relative to the base 12 through the first frame 142. In practice, the side of the keycap 10 on the base 12 can be connected to the base 12 through a structure which allows the keycap 10 to rotate relative to the base 12. Thereby, when the keycap 10 is pressed with the external force F0 to move from an initial position (equal to the position at which the keycap 10 is not pressed yet, as shown by FIG. 14) through a triggering position (as shown by FIG. 15) to a pressed position (as shown by FIG. 16), although the side of the keycap 10 on the base 12 slides on the base 12, the keycap 10 still has different positions, so that the keyswitch structure 7 can perform the same action mechanism as the keyswitch structure 1 and provide a two-stage pressing manipulation. Similarly, when the external force F0 is eliminated from the keycap 10, the keycap 10 moves from the pressed position through the triggering position back to the initial position under the magnetic attraction force F1 produced between and by the second magnetic portion 162 and the first magnetic portion 1422.

In the keyswitch structure 7, the disposition of the keycap 10 also can be applied to the keyswitch structures 3 and 5, which will not be described repeatedly. In addition, in practice, the lift mechanism according to the invention also can produce an up and down levelly moving of the keycap by using a single frame (as the first frame) in coordination with a structure which guides the keycap to move vertically, for example, a guiding slot (fixed on the base) used in the keyswitch structure 7 for guiding the side of the keycap 10 to move in a vertical direction. Other available embodiments can be easily completed by those skilled in the art according to the descriptions of the above-mentioned embodiments and the conventional keyswitch structures and will not be described in addition.

Please refer to FIG. 17 to FIG. 21. A keyswitch structure 8 according to a fifth embodiment includes a keycap 80, a base 82, a lift mechanism 84, and a third frame 86. The keycap 80 is disposed above the base 82. The lift mechanism 84 is connected to and between the keycap 80 and the base 82, so that the keycap 80 is up and down movable relative to the base 82 through the lift mechanism 84. The third frame 86 is disposed between the keycap 80 and the base 82. The third frame 86 interacts with the lift mechanism 84 by magnetic attraction force so as to produce a driving force for the keycap 80 to return. Similarly, the keyswitch structure 8 needs no conventional elastic members e.g. rubber dome to produce a return force for the keycap 80, so the lift mechanism 84 can occupy relatively larger space for disposition, which is conducive to the structural strength and action stability of the lift mechanism 84.

For more details, the lift mechanism 84 includes a first frame 842 and a second frame 844 which are disposed between the keycap 80 and the base 82. The first frame 842 is pivotally connected to the inner side of the second frame 844, so that the first frame 842 and the second frame 844 form a scissors structure which is conducive to the action stability of the lift mechanism 84. Furthermore, the first frame 842 and the second frame 844 are movably connected to two opposite sides of the keycap 80 respectively, which is conducive to stably supporting the keycap 80 by the lift mechanism 84. The keycap 80 is supported by the first frame 842 and the second frame 844 and can move up and down relative to the base 82 through the first frame 842 and the second frame 844. The base 82 includes a lower plate 822 and an upper cover 824. The upper cover 824 is engaged to the lower plate 822, so that the upper cover 824 and the lower plate 822 form an accommodating space 820. The lower plate 822 includes a base plate 8222 and a circuit board 8224 (for example but not limited to a printed circuit board or a membrane circuit board) stacked on the base plate 8222. The circuit board 8224 includes a first switch contact 8224*a* and a second switch contact 8224*b*. In the embodiment, the first switch contact 8224*a* is realized by a conductive support soldered on a solder pad on the circuit board 8224 and protruding out of the circuit board 8224. The second switch contact 8224*b* is realized by another solder pad on the circuit board 8224. The above realization of the first switch contact 8224*a* and the second switch contact 8224*b* depends on the structure of the third frame 86, so in practice, both the first switch contact 8224*a* and the second switch contact 8224*b* can be realized by conductive supports or by solder pads. For the latter case, for example, the third frame 86 can be structurally modified to include the conductive support (in this case, this conductive support is not soldered onto the corresponding solder pad), and the corresponding solder pad is taken as the first switch contact 8224*a*.

Figure 20:
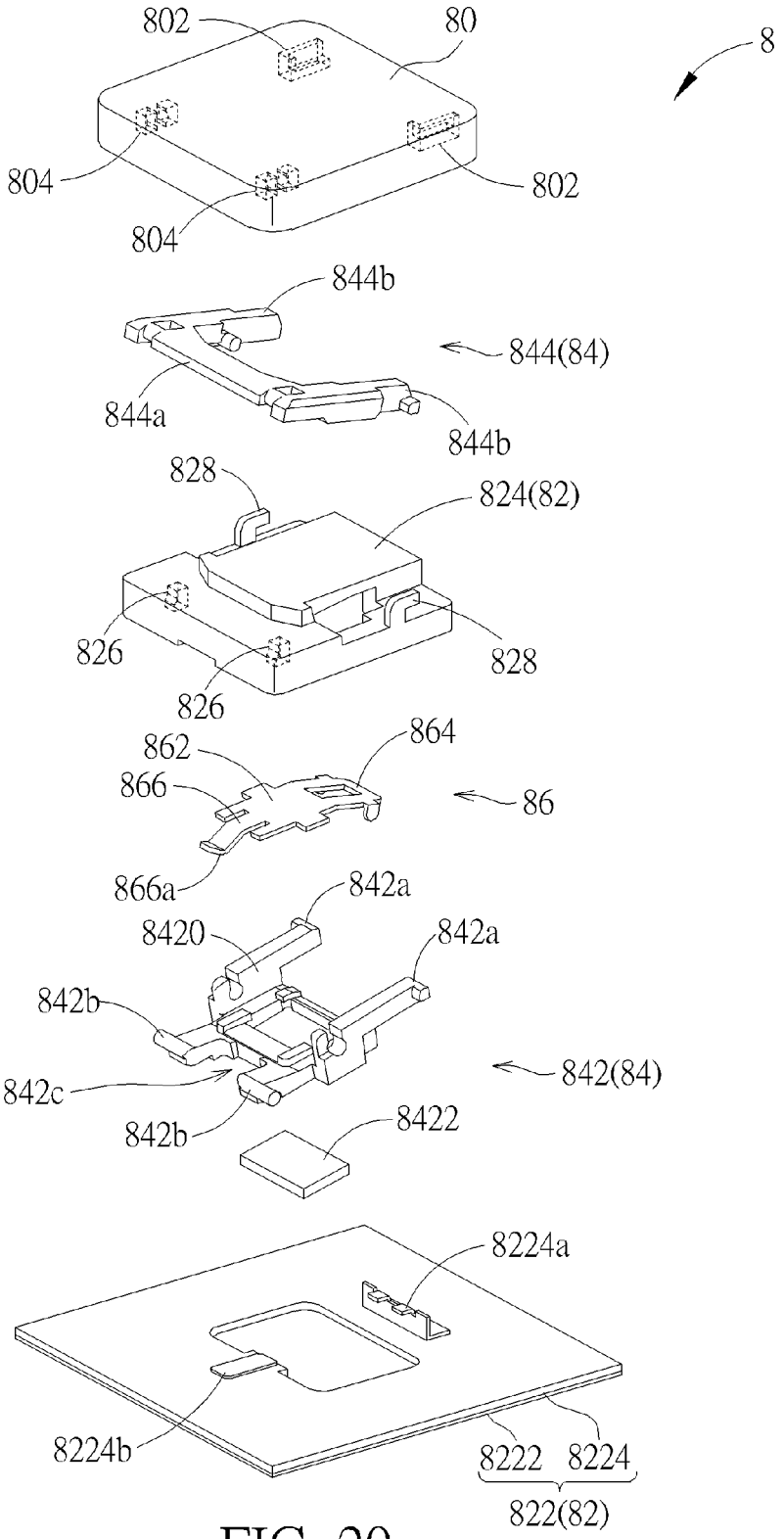
FIG. 20 is an exploded view of the keyswitch structure in FIG. 17.

Furthermore, two end portions 842*a* and 842*b* of the first frame 842 (i.e. the upper end and lower end of the first frame 842) are rotatably connected to a connection portion 802 (of which the hidden profile is shown in dashed in FIG. 20) of the keycap 80 and a connection portion 826 (located on an inner surface of the upper cover 824, of which the hidden profile is shown in dashed in FIG. 20) of the base 82 respectively. Two end portions 844*a* and 844*b* of the second frame 844 (i.e. the upper end and lower end of the second frame 844) are rotatably connected to a connection portion 804 (of which the hidden profile is shown in dashed in FIG. 20) of the keycap 80 and a connection portion 828 of the base 82 respectively. Therein, the connection portion 828 is disposed directly on an outer surface of the upper cover 824. Strictly speaking, the connection portion 826 is formed by the inner structure of the upper cover 824 in coordination with the lower plate 822 (or the circuit board 8224); however, in practice, the connection portion 828 can be realized by the upper cover 824 alone. The first frame 842 includes a first magnetic portion 8422. For example, the first frame 842 is provided by a plastic frame body 8420 with a magnet (taken as the first magnetic portion 8422) embedded therein. The third frame 86 includes a second magnetic portion 862, a supporting portion 864, and an extending arm 866 which are interconnected. The third frame 86 also includes a triggering portion 866*a* disposed at a free end of the extending arm 866. The supporting portion 864 and the triggering portion 866*a* are located at two opposite sides of the third frame 86 respectively. The third frame 86 is rotatably supported on the base 82 through the supporting portion 864. The second magnetic portion 862 is located between the keycap 80 and the first magnetic portion 8422. The second magnetic portion 862 and the first magnetic portion 8422 produce a magnetic attraction force F3 (indicated by a line segment with two arrows in the figures) therebetween. In the embodiment, the third frame 86 and the first magnetic portion 8422 are located in the accommodating space 820. The first switch contact 8224*a* and the second switch contact 8224*b* are also located in the accommodating space 820. The upper end of the first frame 842 (i.e. the end portion 842*a*) extends above the upper cover 824 to connect with the keycap 80. Thereby, the upper cover 824 can reduce the probability that an external magnetic object (e.g. steel or iron filings) is attracted by the magnetic attraction force F3 to enter the accommodating space 820 between the second magnetic portion 862 and the first magnetic portion 8422, so that the action stability of the first frame 842 and the third frame 86 is enhanced and the reliability of the electrical contacts between the third frame 86 and the first switch contact 8224*a* and the second switch contact 8224*b* is also enhanced.

In addition, in practice, if the keyswitch structure 8 has additional dust-proof structure (e.g. when the keyswitch structure 8 is applied to a keyboard that has an elastic film sticking on the keycap 80 and the top surface of the device case of the keyboard and spreading over gaps between the keycap 80 and the device case), the upper cover 824 can be omitted. In this case, the first frame 842 and the second frame 844 can be connected directly to the lower plate 822 or the base plate 8222. For example, if the base plate 8222 is a metal plate, the base plate 8222 can be stamped directly to bend upward to form connection structures like the connection portions 826 and 828. The circuit board 8224 has corresponding holes for the connection structures to pass through, which is conducive to the connection of the first frame 842 and the second frame 844 with the base plate 8222.

Figure 21:
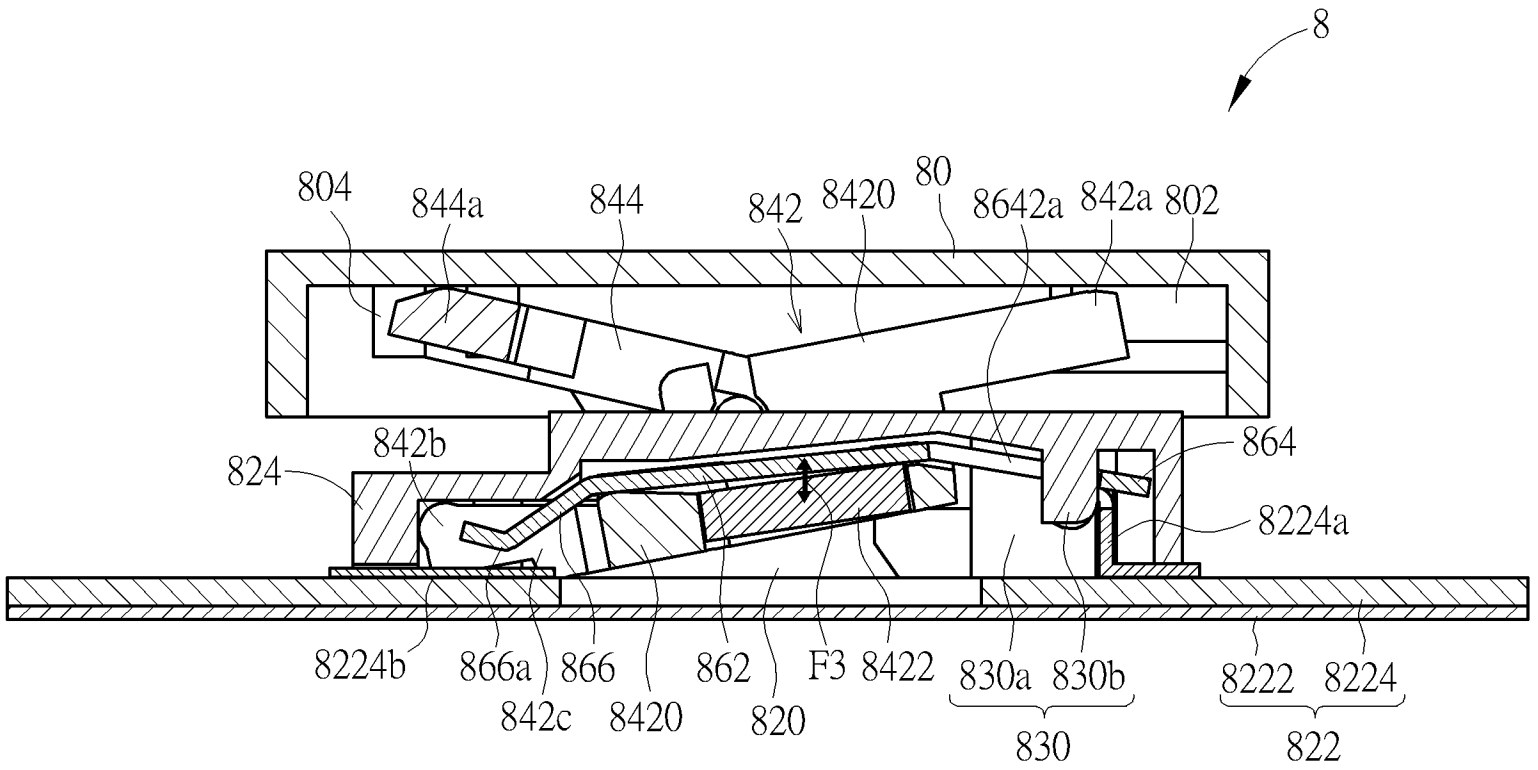
FIG. 21 is a sectional view of the keyswitch structure in FIG. 17 along the line Y-Y when a keycap thereof is not pressed with an external force yet and is located at an unpressed position.
Figure 22:
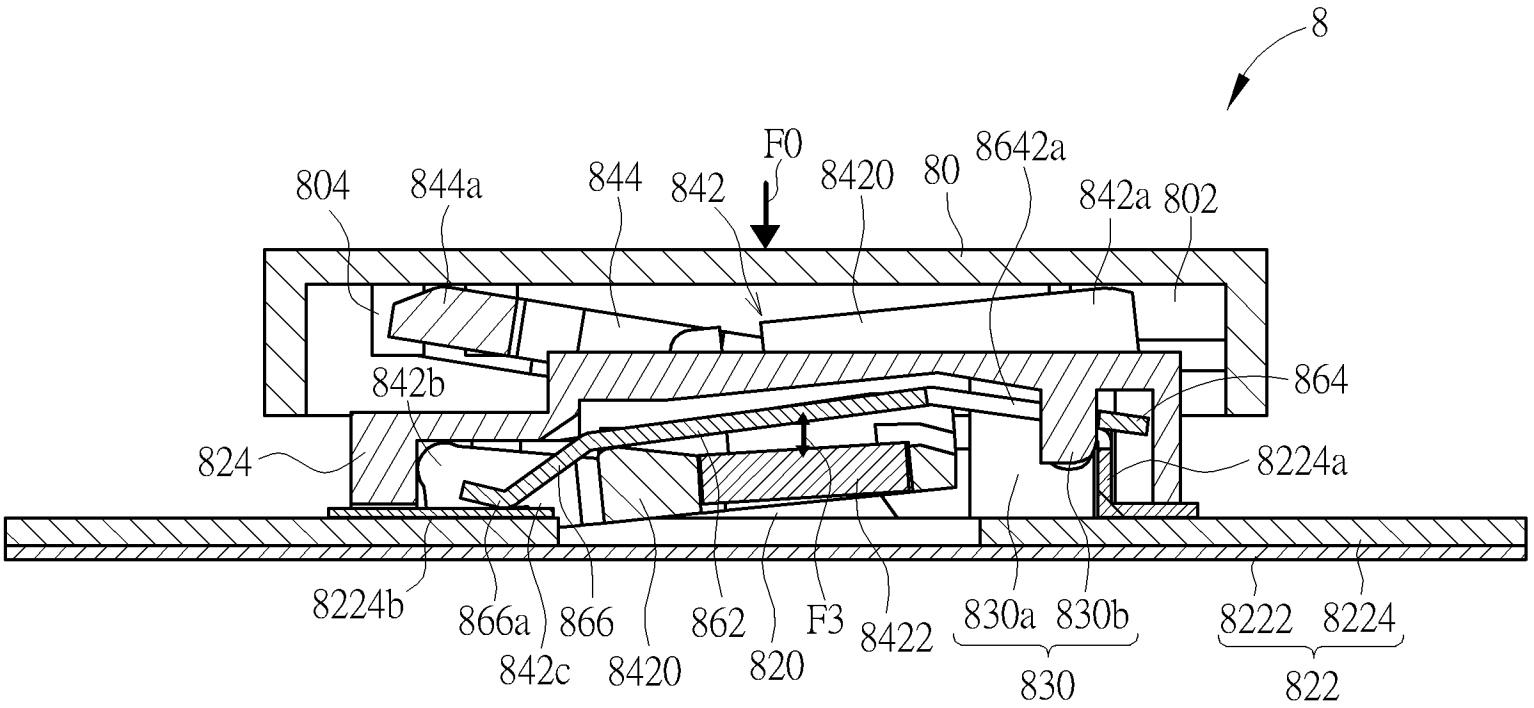
FIG. 22 is a sectional view of the keyswitch structure in FIG. 17 along the line Y-Y when the keycap is pressed with the external force to move to a triggering position.
Figure 23:
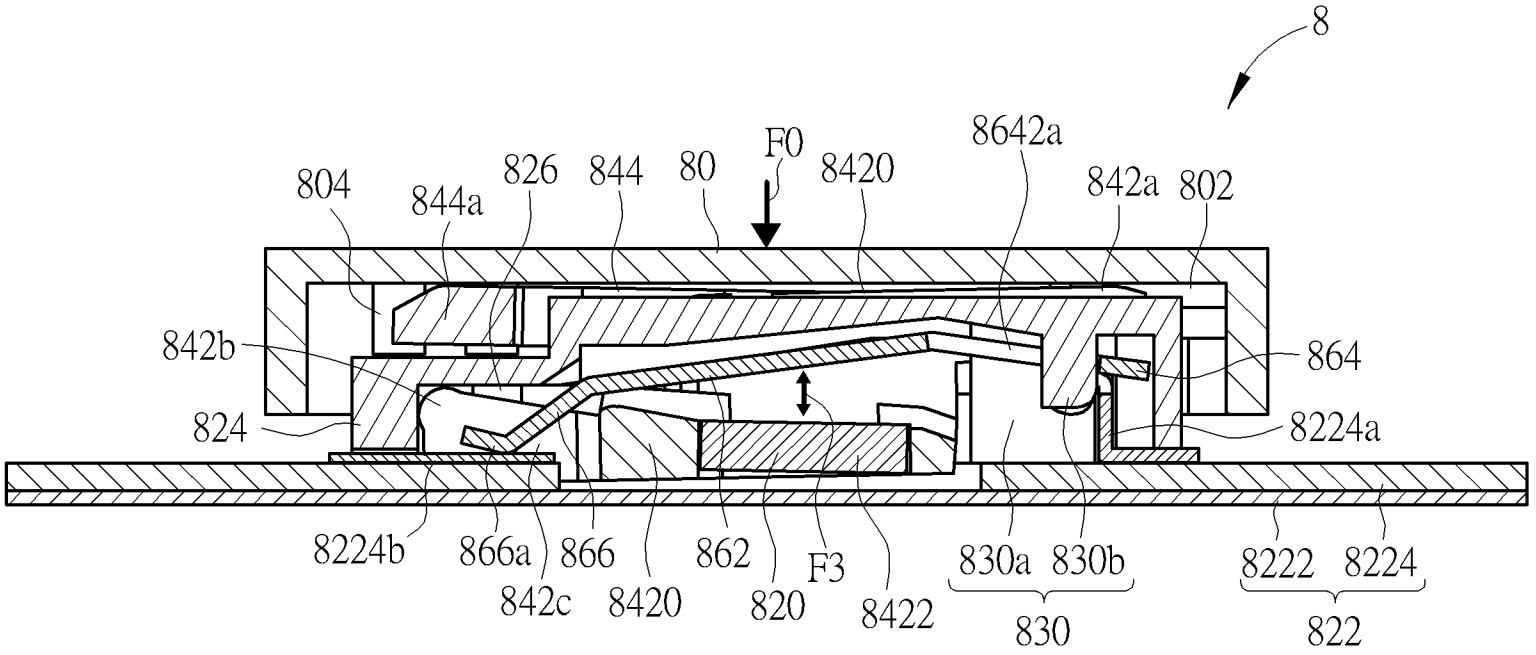
FIG. 23 is a sectional view of the keyswitch structure in FIG. 17 along the line Y-Y when the keycap is pressed with the external force to move to a pressed position.

In the embodiment, the extending arm 866 of the third frame 86 is located between the keycap 80 and the base 82 and also between the keycap 80 and the first frame 842. When the keycap 80 is pressed with an external force F0 to move toward the base 82, the first frame 842 is driven by the keycap 80 to move toward the base 82, and the third frame 86 also move downward under the attraction effect of the magnetic attraction force F3 to the second magnetic portion 862, as shown by FIG. 21 to FIG. 23. In other words, the magnetic attraction force F3 drives the third frame 86 to move toward the base 82 and keep abutting against (i.e. applying a force to) the first frame 842. Therein, in practice, the keyswitch structure 8 is placed vertically, so in principle, the third frame 86 also has a tendency to move downward due to its weight.

Figure 24:
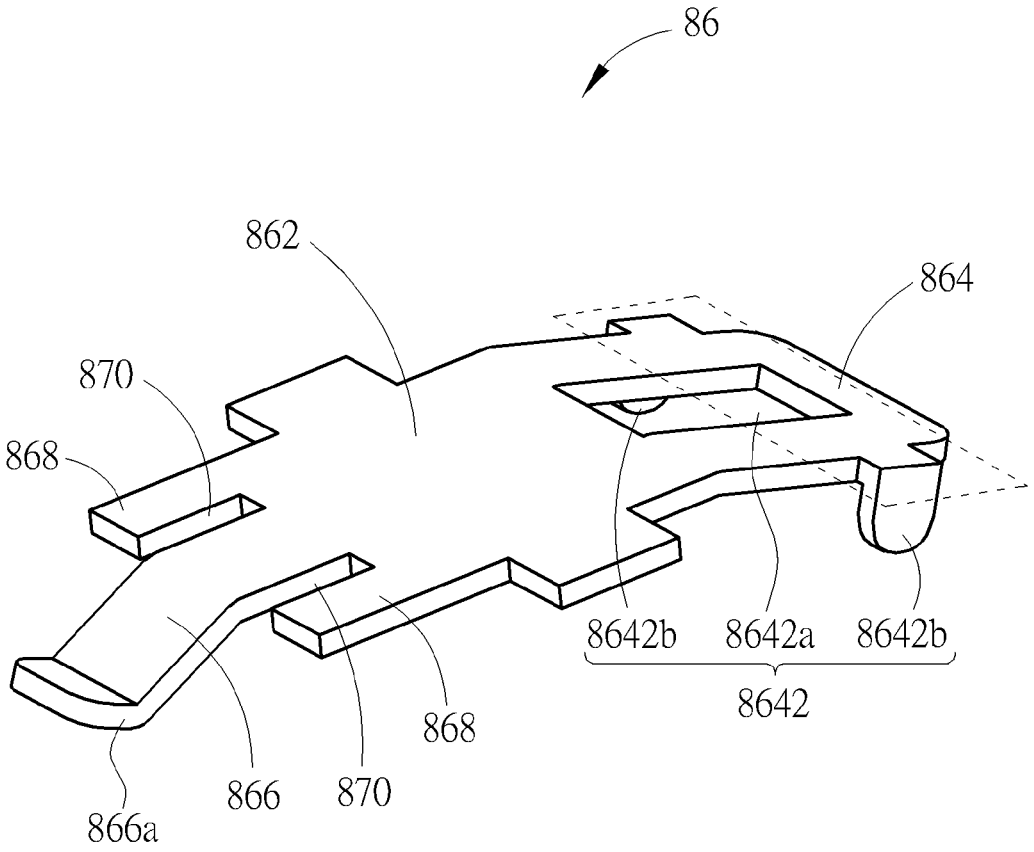
FIG. 24 is a schematic diagram illustrating a third frame of the keyswitch structure in FIG. 20.

Furthermore, please also refer to FIG. 24. In the embodiment, the third frame 86 further includes two engaging portions 868 and two slots 870. The two engaging portions 868 are located at two opposite sides of the third frame 86 respectively. The extending arm 866 is located between the two engaging portions 868 and is separated from the two engaging portions 868 by the two slots 870. As shown by FIG. 20, in the embodiment, the first frame 842 further includes a U-shaped indentation 842*c* and two ends (i.e. the end portion 842*b*, or the lower end of the first frame 842). The two ends are located at two opposite sides of the U-shaped indentation 842*c*. The extending arm 866 extends into the U-shaped indentation 842*c* toward the second switch contact 8224*b*. The two engaging portions 868 extends along two opposite sides of the center line of the first frame 842, so the third frame 86 can apply force to the first frame 842 evenly through the two engaging portions 868.

As shown by FIG. 21, when the keycap 80 is not pressed with the external force F0, and the keycap 80 is located at an unpressed position (or an initial position), the magnetic attraction force F3 makes the first magnetic portion 8422 and the second magnetic portion 862 have a tendency to keep approaching each other, so that the first frame 842 and the third frame 86 are stably supported on the base 82 to make the keycap 80 remain at the unpressed position. When the keycap 80 is pressed with the external force F0 to move down from the unpressed position (as shown by FIG. 21) toward a triggering position (as shown by FIG. 22), the first magnetic portion 8422 and the second magnetic portion 862 depart from each other, the magnetic attraction force F3 drives the third frame 86 to rotate about the supporting portion 864, and the triggering portion 866*a* moves toward the base 82. Therein, the second magnetic portion 862 is located between the supporting portion 864 and the triggering portion 866*a*, so during the movement of the keycap 80 toward the base 82, the third frame 16 rotates substantially about the supporting portion 864, so that the triggering portion 866*a* can move toward the second switch contact 8422*b*.

In the embodiment, the third frame 86 is made of a metal plate, so the triggering portion 866*a* and the supporting portion 864 are electrically conducted. The supporting portion 864 keeps abutting against the first switch contact 8224*a*; that is, the supporting portion 864 keeps electrically contacting the first switch contact 8224*a*. As shown by FIG. 22, when the keycap 80 moves down and reaches the triggering position, the triggering portion 866*a* is driven to move down to is electrically coupled to the second switch contact 8224*b* in response to the triggering portion 866*a* abutting against the second switch contact 8224*b*, so that the first switch contact 8224*a* and the second switch contact 8224*b* are electrically conducted.

As shown by FIG. 22, the keycap 80 reaches the triggering position. Although the first frame 842 will proceed to rotate as the keycap 80 move downward further after the triggering portion 866*a* contacts the second switch contact 8224*b*, the third frame 86 will not synchronously rotate as the first frame 842 rotates in principle because the left and right ends of the third frame 86 have abutted against the two switch contacts 8224*a* and 8224*b*, which makes the extending arm 866 and the first frame 842 separate. During the movement of the keycap 80 moving toward the base 82 from the triggering position (as shown by FIG. 22) to a pressed position (as shown by FIG. 23) under the external force F0, the magnetic attraction force F3 gradually decreases as the distance between the first magnetic portion 8422 and the second magnetic portion 862 gradually increases. Therefore, it is required to choose the first magnetic portion 8422 and the second magnetic portion 862 properly so that the magnetic attraction force is enough to drive the keycap 80 at the pressed position to move upward to the unpressed position.

When the external force F0 for pressing the keycap 80 downward disappears (e.g. removing the user's finger away from the keycap 80), the magnetic attraction force F3 drives the first magnetic portion 8422 and the second magnetic portion 862 to approach each other, so that the keycap 80 moves from the relatively low pressed position, through the triggering position, and back to the relatively high initial position (i.e. the position where the keycap 80 is not pressed, or the unpressed position) and the first frame 842 and the third frame 86 contact each other and are stably supported on the base 82, as shown FIG. 21.

In principle, when the keycap 80 is located between the unpressed position and the triggering position, the third frame 86 applies force to the first frame 842 through the two engaging portions 868. In practice, by the two slots 870, the deformation or deflection curve of the extending arm 866 can be different from that of the two engaging portions 868, so it is practicable to design the structures of the extending arm 866 and the two engaging portions 868 such that when the triggering portion 866*a* just contacts the second switch contact 8224*b*, there exists a force buffer, in which when the keycap 80 proceeds to move downward, the two engaging portions 868 keep abutting against the first frame 842 and the extending arm 866 deforms relatively upward. Thereby, the impact force (or triggering force) by which the triggering portion 866*a* contacts the second switch contact 8224*b* can be reduced. The fatigue resistivity of the extending arm 866 can be enhanced; that is, the durability of the extending arm 866 elastically deforming to contact the second switch contact 8224*b* through the triggering portion 866*a* can be enhanced. The surface structure (e.g. bare copper layer or plating layer of the solder pad) of the second switch contact 8224*b* can be maintained so that the service life of the second switch contact 8224*b* can be prolonged. For example, according to a beam theory (e.g. Timoshenko beam theory), the above purpose can be easily achieve by designing the moment of inertia (or second axial moment) of the extending arm 866 to be relatively small (relative to the moment of inertia of the two engaging portions 868).

Figure 25:
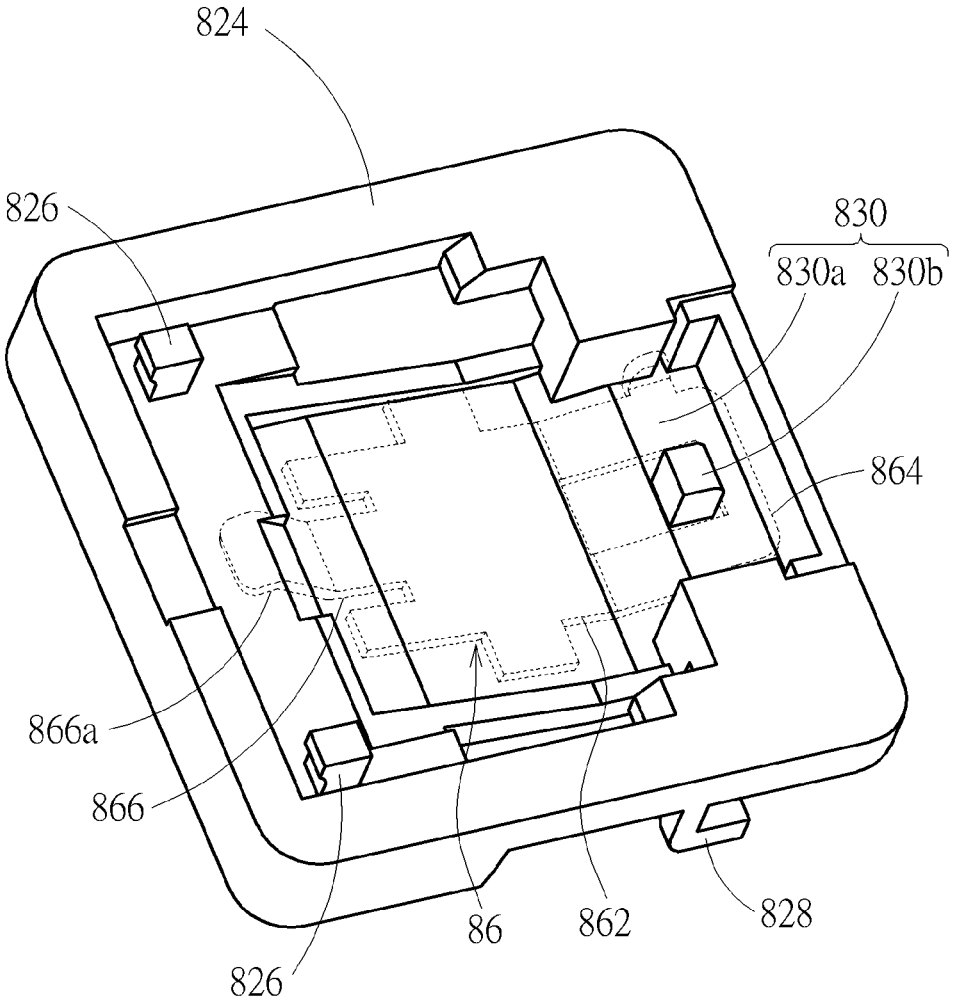
FIG. 25 is a schematic diagram illustrating an upper cover of a base of the keyswitch structure in FIG. 20 in another view point.

In addition, please also refer to FIG. 25; therein, the profile of the third frame 86 is shown in dashed lines in the figure for showing the assembly relation between the third frame 86 and the upper cover 824. In the embodiment, the upper cover 824 has a first engagement structure 830 on an inner surface thereof. The supporting portion 864 has a second engagement structure 8642 (indicated by a dashed frame in FIG. 24). The third frame 86 is rotatable around where the first engagement structure 830 and the second engagement structure 8642 are engaged. For more details, in the embodiment, the first engagement structure 830 includes a recess 830*a* and a post 830*b* in the recess 830*a*. The second engagement structure 8642 includes a hole 8642*a* and two bent portions 8642*b* at two opposite sides of the supporting portion 864. The supporting portion 864 abuts against the first switch contact 8224*a*, so that the second engagement structure 8642 as a whole can remain in the recess 830*a*. Therein, the post 830*b* passes through the hole 8642*a*. The bent portions 8642*b* structurally fits not only the recess 830*a* but also the first switch contact 8224*a* (as a whole showing a Z-shaped structure), which leads to a limitation effect that is conducive to the action stability of the third frame 86.

As described above, the action of the keyswitch structure 8 is substantially the same as the keyswitch structure 1, especially for the interaction (based on the magnetic attraction force F3) between the first frame 842 and the third frame 86. Therefore, for other descriptions about components of the keyswitch structure 8 and variants thereof, please refer to the relevant descriptions of the keyswitch structure 1 and the variants thereof, which will not be described in addition. For example, the description about the fourth embodiment (based on that the lift mechanism 14 is realized by only the first frame 142) is also applicable herein, which will not be described in addition.

Figure 26:
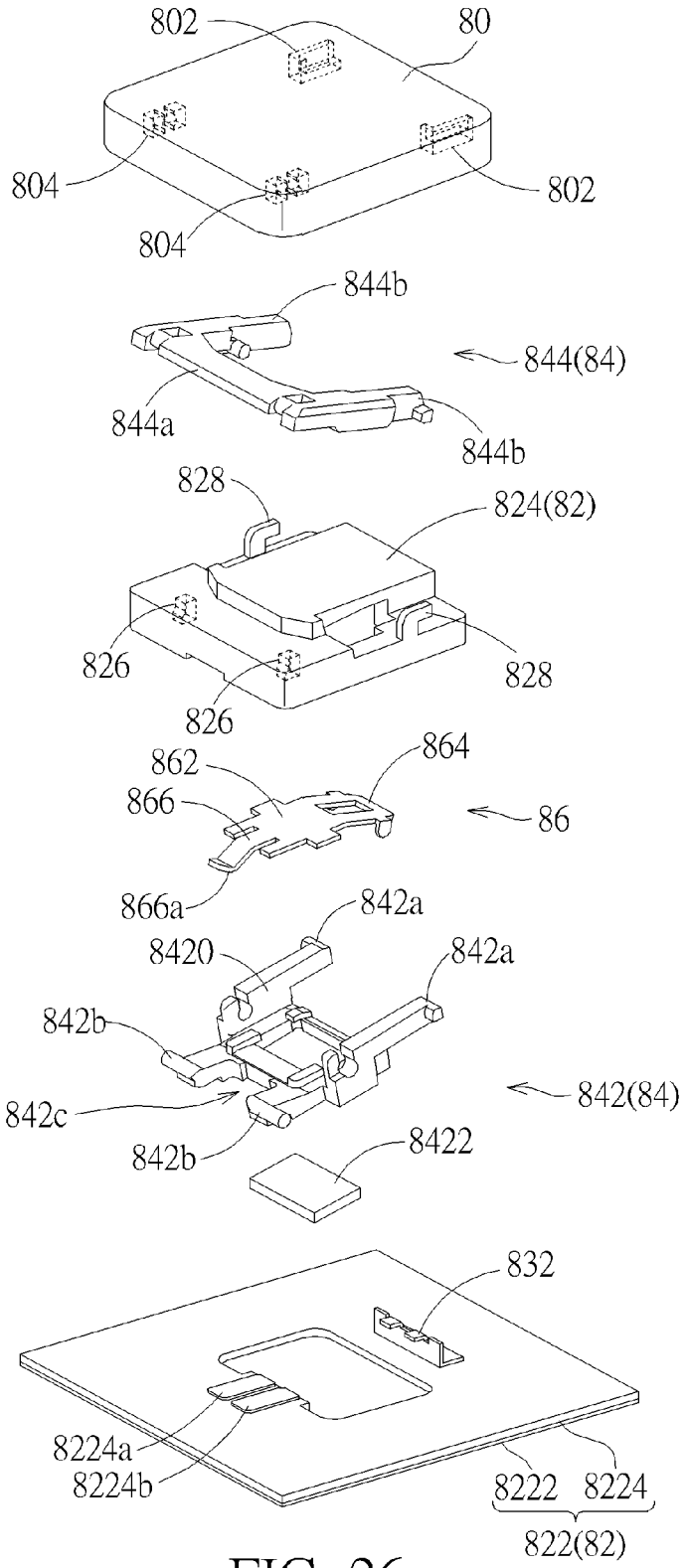
FIG. 26 is an exploded view of a keyswitch structure according to another embodiment.

In addition, in the embodiment, the first switch contact 8224*a* and the second switch contact 8224*b* are conducted by the whole third frame 86, not only by the triggering portion 866*a*; however, the invention is not limited thereto. Please also refer to FIG. 26. FIG. 26 is an exploded view of a keyswitch structure according to another embodiment. For simple illustration, the keyswitch structure in FIG. 26 is substantially similar in structure to the keyswitch structure 8, so the keyswitch structure in FIG. 26 uses the reference numbers used in the keyswitch structure 8. For other descriptions about components of the keyswitch structure in FIG. 26 (including the action of the third frame 86), please refer to the relevant descriptions of the keyswitch structure 1, which will not be described in addition. Furthermore, for simplification of the structural difference between the keyswitch structure in FIG. 26 and the keyswitch structure 8, the embodiment retains the Z-shaped support 832 which is soldered on the circuit board 8224 only for the supporting portion 864 of the third frame 86 to abut against without other electrical purposes. A difference between the keyswitch structure in FIG. 26 and the keyswitch structure 8 is that the first switch contact 8224*a* and the second switch contact 8224*b* are located at the same side of the third frame 86 and are realized by solder pads on the circuit board 8224. Therefore, when the keycap 80 reaches the triggering position, the triggering portion 866*a* electrically contacts the first switch contact 8224*a* and the second switch contact 8224*b* simultaneously, which also leads to an electrical conduction between the first switch contact 8224*a* and the second switch contact 8224*b*; therefore, an electric current is capable to flow from the first switch contact 8224*a* to the second switch contact 8224*b* through the triggering portion 866*a* or from the second switch contact 8224*b* to the first switch contact 8224*a* through the triggering portion 866*a*. In the embodiment, it is practicable that only the surface of the third frame 86 which is used for contacting the first switch contact 8224*a* and the second switch contact 8224*b* is electrically conductive. Then, the third frame 86 can be made of non-metal material (e.g. polymer material). The second magnetic portion 862 can be formed by attaching a metal sheet or a magnet onto the third frame 86.

Figure 27:
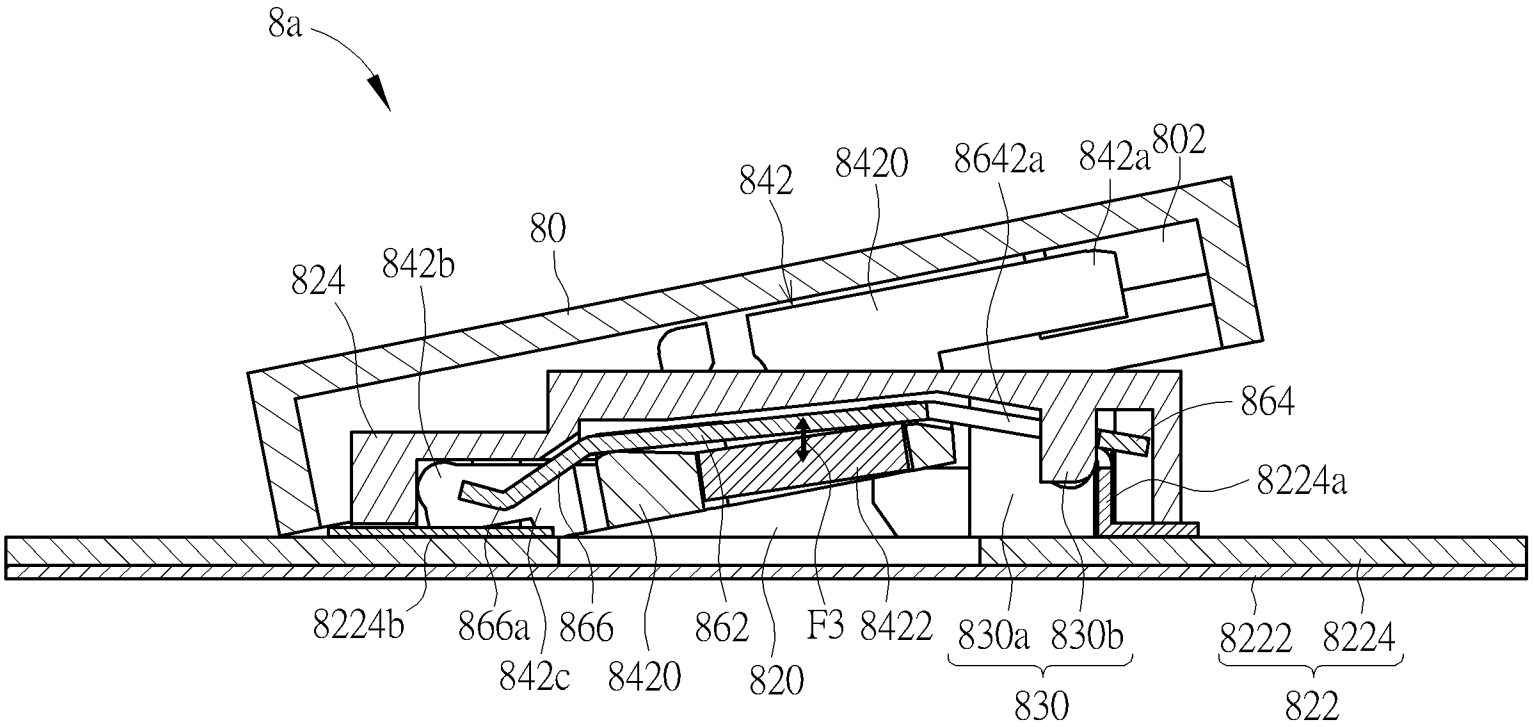
FIG. 27 is a sectional view of a keyswitch structure according to another embodiment.

In the keyswitch structure 8, the lift mechanism 84 is realized by the first frame 842 and the second frame 844, but the invention is not limited thereto. Like the variant of the keyswitch structure 7 relative to the keyswitch structure 1, the keyswitch structure 8 also can be modified to use only the first frame 842 as the lift mechanism 84, as shown by the keyswitch structure 8*a* in FIG. 27. In the keyswitch structure 8*a*, the keycap 80 can swing up and down relative to the base 82, so the keycap 80 also can perform a movement relative to the base 82, which realizes the variant of the position of the keycap 80 relative to the base 82; that is, the keycap 80 can move between an unpressed position (or initial position) and a pressed position with passing through a triggering position. Furthermore, in the keyswitch structure 8*a*, because of a lack of the second frame 844, it is unnecessary to dispose the connection portion 828 on the upper cover 824 and the connection portion 804 on the keycap 80. In addition, for descriptions about the action of the keycap 80 of the keyswitch structure 8*a*, please refer to the relevant descriptions and figures about the keycap 10 of the keyswitch structure 7, which will not be described in addition.

Figure 28:
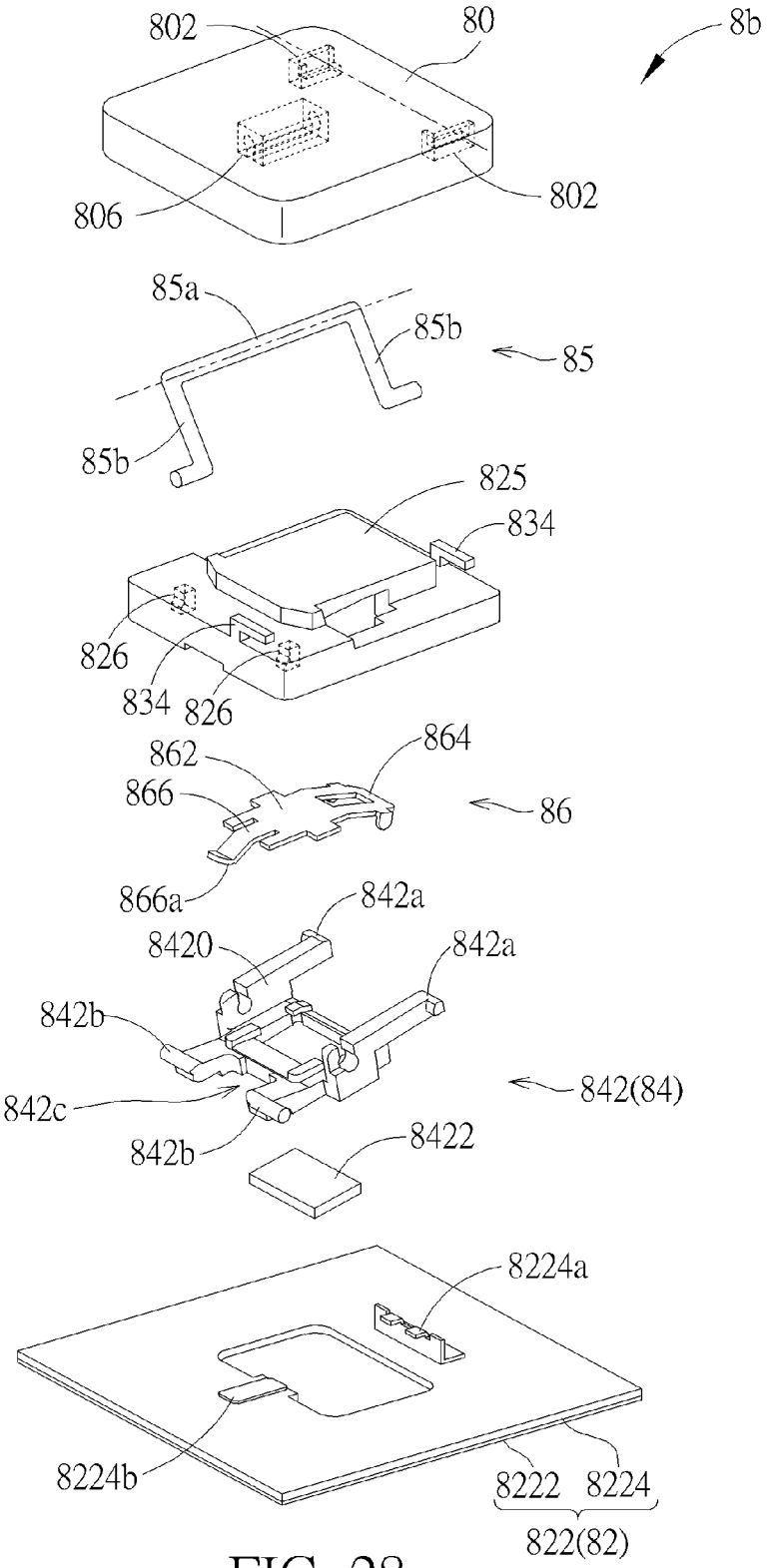
FIG. 28 is an exploded view of a keyswitch structure according to a sixth embodiment.
Figure 29:
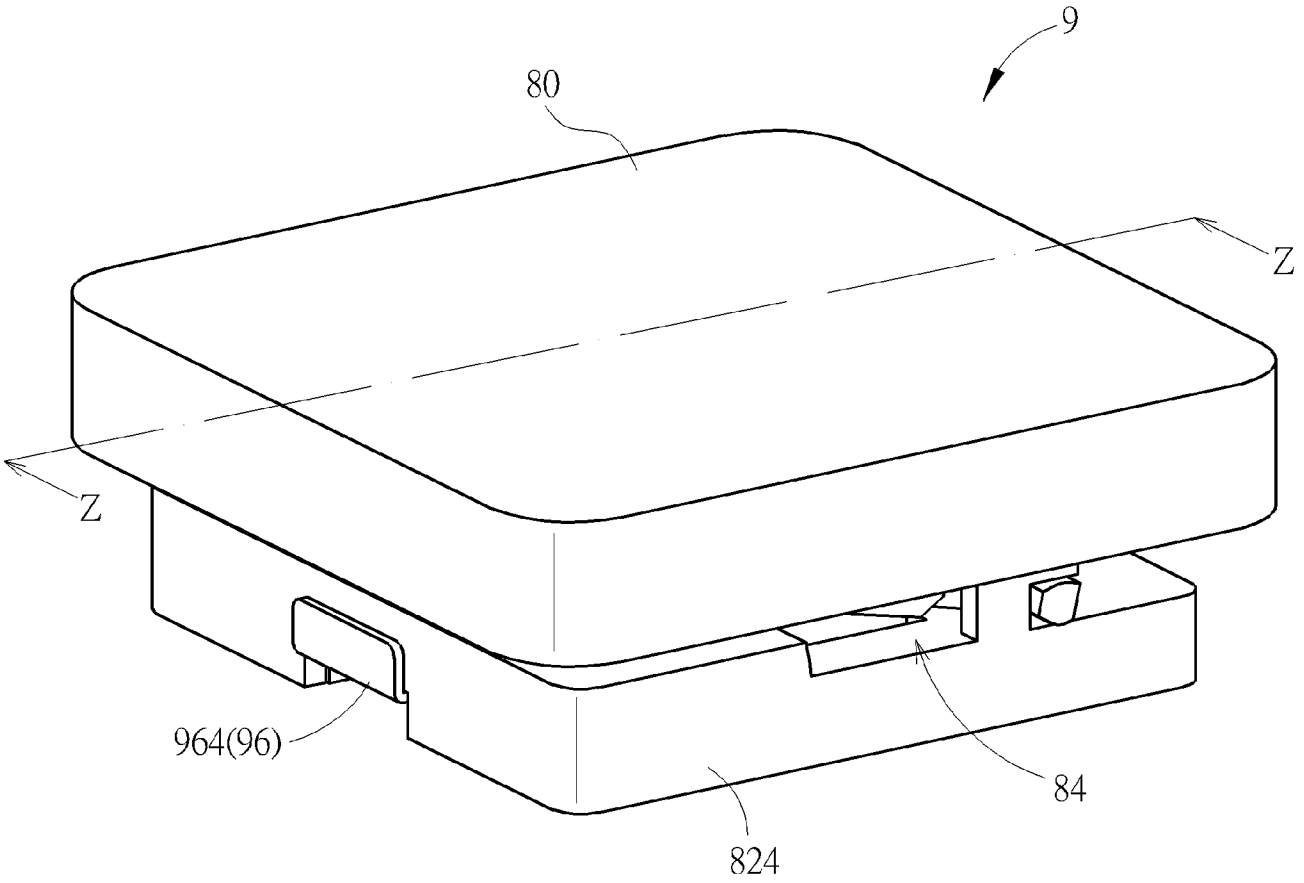
FIG. 29 is a schematic diagram illustrating a switch structure according to a seventh embodiment.
Figure 30:
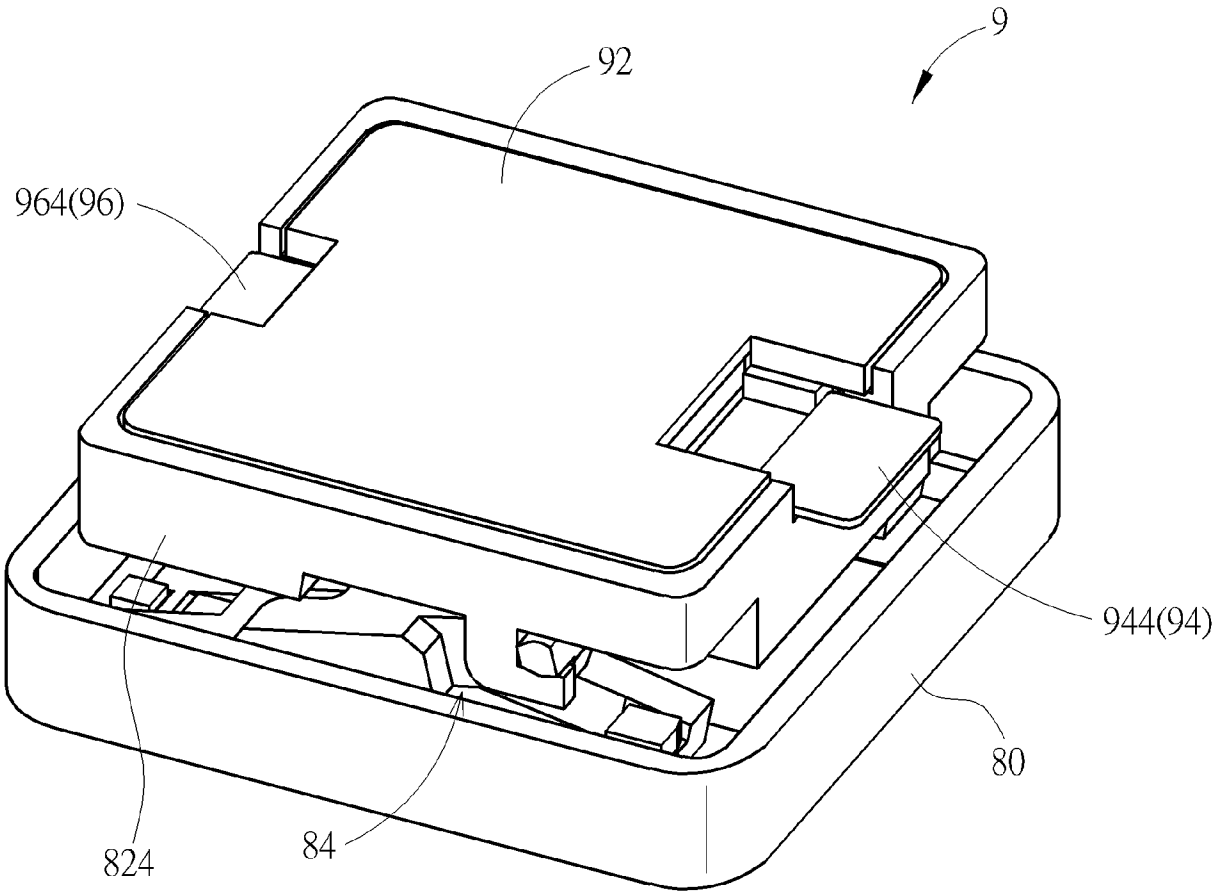
FIG. 30 is a schematic diagram illustrating the switch structure in FIG. 29 in another view point.
Figure 31:
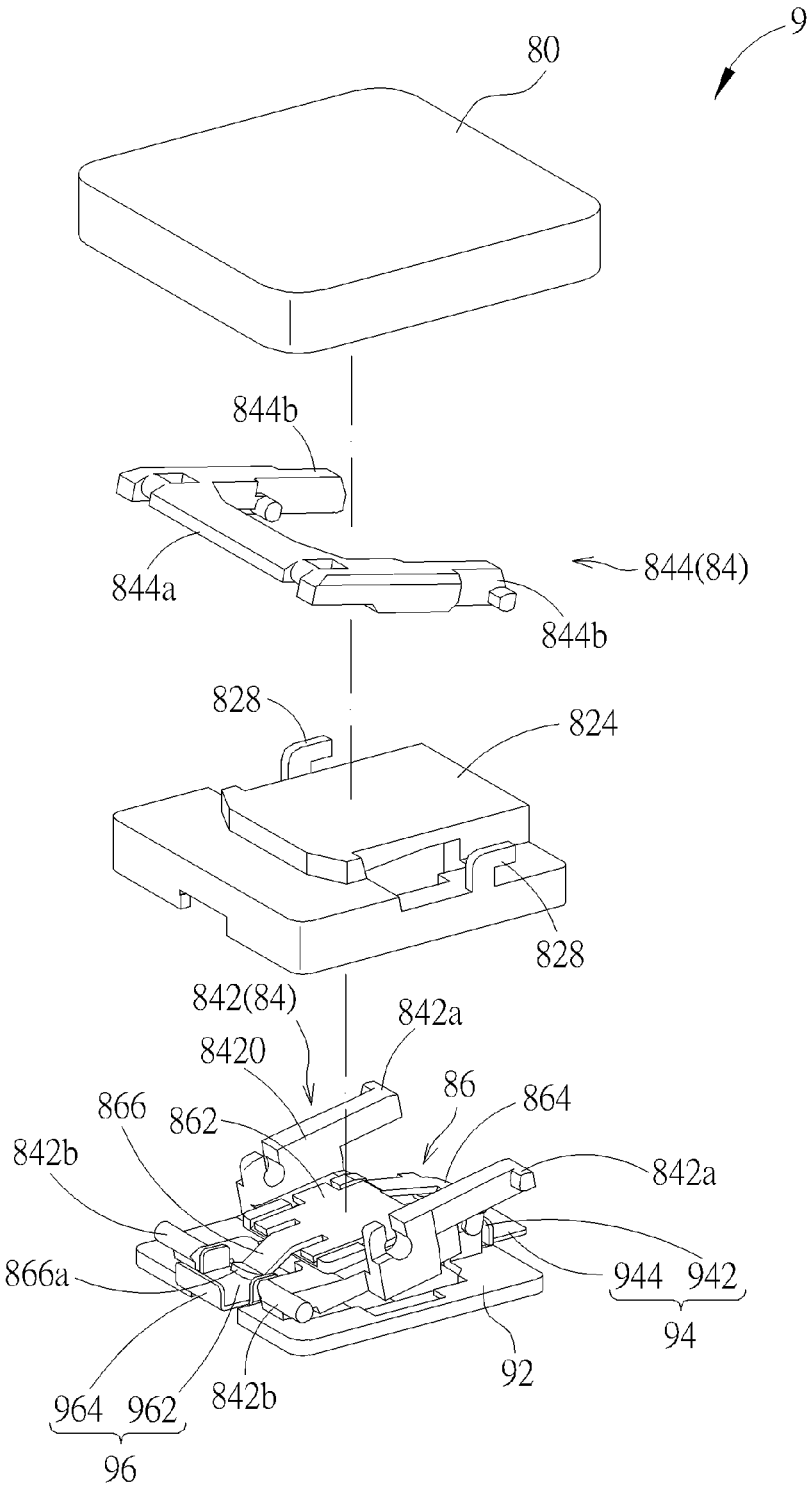
FIG. 31 is a partially exploded view of the switch structure in FIG. 29.
Figure 32:
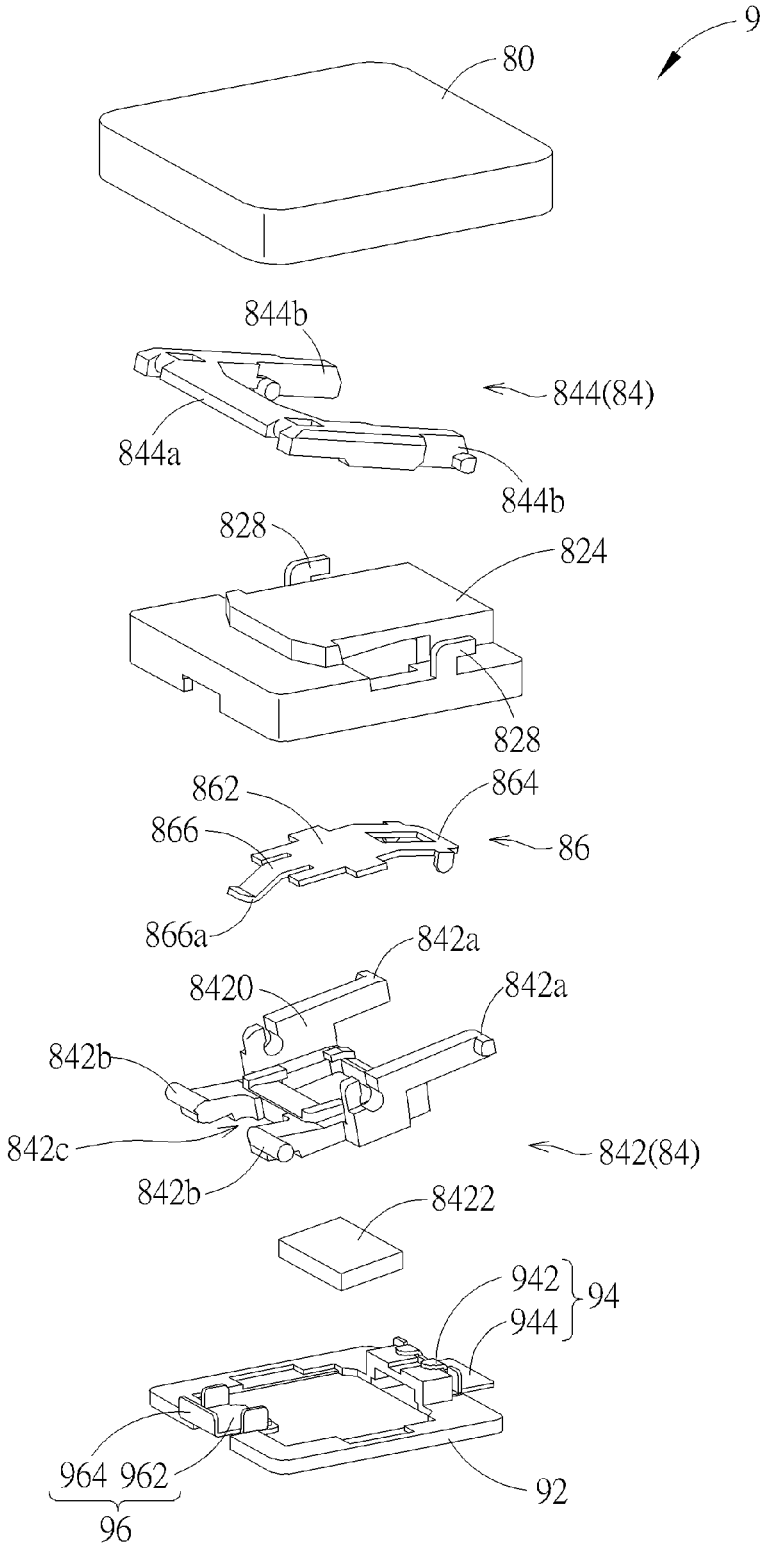
FIG. 32 is an exploded view of the switch structure in FIG. 29.

In addition, in practice, the keyswitch structures 7 and 8*a* can be provided with a balance bar for constraining the up and down movement of the keycaps 10 and 80 so that the keycaps 10 and 80 can also levelly move up and down. As shown by FIG. 28, a keyswitch structure 8*b* according to a sixth embodiment is shown. Compared with the keyswitch structure 8*a*, the keyswitch structure 8*b* further includes a balance bar 85 connected to and between the keycap 80 and the base 82. For more details, the balance bar 85 includes a long shaft body 85*a* and two connecting arms 85*b* connected to two ends of the long shaft body 85*a* respectively. The balance bar 85 as a whole shows a reverse U-shaped structure. The balance bar 85 is pivotally connected to a connection portion 806 of the keycap 80 through the long shaft body 85*a*. The balance bar 85 is rotatably and slidably engaged with a connection portion 834 (realized by two sliding slots) of the upper cover 825 through the two connecting arms 85*b*. The keycap 80 has two supporting points (i.e. the connection portion 802). The first frame 842 is movably engaged with the keycap 80 through the two supporting points. The longitudinal axis (substantially equal to the extending direction of the long shaft body 85*a* and indicated by a chained line in FIG. 28) of the balance bar 85 is perpendicular to a line (indicated by another chained line in FIG. 28) connecting the two supporting points. Thereby, the keycap 80 is constrained in two non-parallel directions corresponding to the longitudinal axis of the balance bar 85 and the line connecting the two supporting points respectively, and then can levelly move up and down. In addition, in practice, the connecting arms 85*b* of the balance bar 85 can be changed to connect with the lower plate 822. For example, the keycap 80 can be modified to be with a larger area so that the keycap 80 is significantly larger than the upper cover 825 and then the connecting arms 85*b* can be easily connected to the lower plate 822 or the base plate 8222 (for example, the circuit board 8224 has corresponding holes for the connection of the connecting arms 85*b* with the base plate 8222). In addition, it is evident that the above balance bar 85 also can be applicable to the keyswitch structure 7.

The above keyswitch structure 8 also can be applicable to a switch structure. Please refer to FIG. 29 to FIG. 32, which show a switch structure 9 according to a seventh embodiment. The switch structure 9 is similar in structure to the keyswitch structure 8. For simple illustration, the switch structure 9 uses the reference numbers used in the keyswitch structure 8. For other descriptions about components of the switch structure 9, please refer to the relevant descriptions about the components with the same names in the keyswitch structure 8, which will not be described in addition. In the embodiment, the switch structure 9 includes a keycap 80, a carrier 92, a first terminal 94, a second terminal 96, a lift mechanism 84, and a third frame 86. The keycap 80 is disposed above the carrier 92. The first terminal 94 and the second terminal 96 are fixed on the carrier 92. The lift mechanism 84 is connected to and between the keycap 80 and the carrier 92, so that the keycap 80 can move up and down relative to the carrier 92 through the lift mechanism 84. The third frame 86 is disposed between the keycap 80 and the carrier 92. The third frame 86 and the lift mechanism 84 interact with each other through a magnetic attraction force F3 which is used for providing the keycap 80 with a driving force for moving back to its original position. Similarly, the switch structure 9 can provide the keycap 80 with a return force without a conventional elastic member (e.g. a rubber dome), so that the lift mechanism 84 can obtain a relatively large space for the disposition, which is conducive to the structural strength and action stability of the lift mechanism 84.

Furthermore, the lift mechanism 84 includes a first frame 842 and a second frame 844 which are disposed between the keycap 80 and the carrier 92. The first frame 842 is pivotally connected to the inside of the second frame 844, so that the first frame 842 and the second frame 844 form a scissors structure which is conducive to the action stability of the lift mechanism 84. Furthermore, the first frame 842 and the second frame 844 are movably connected to two opposite sides of the keycap 80 respectively, which is conducive to stably supporting the keycap 80 by the lift mechanism 84. The keycap 80 is supported by the first frame 842 and the second frame 844 and can move up and down relative to the carrier 92 through the first frame 842 and the second frame 844. In the embodiment, the switch structure 9 also includes an upper cover 824. The upper cover 824 is engaged to the carrier 92, so that the upper cover 824 and the carrier 92 form an accommodating space 920. The first terminal 94 includes a first switch contact 942 and a first exposed contact 944 electrically connected to the first switch contact 942. The second terminal 96 includes a second switch contact 962 and a second exposed contact 964 electrically connected to the second switch contact 962. Therein, the first switch contact 942 and the second switch contact 962 are covered by the upper cover 824 and are located in the accommodating space 920. The first exposed contact 944 and the second exposed contact 964 are exposed out of the upper cover 824. In the embodiment, the upper cover 824 and the carrier 92 together clamp the first terminal 94 and the second terminal 96. In practice, the first terminal 94 and the second terminal 96 can be fixed on the carrier 92 by being embedded or inserted in the carrier 92; for example, the carrier 92 is a plastic injection molded part.

Furthermore, the first frame 842 includes a first magnetic portion 8422; for example, the first frame 842 is formed by a plastic frame with a magnet embedded therein. The third frame 86 includes a second magnetic portion 862, a supporting portion 864, and an extending arm 866 which are interconnected. The third frame 86 also includes a triggering portion 866*a* disposed at a free end of the extending arm 866. The third frame 86 is rotatably supported on the carrier 92 through the supporting portion 864. The second magnetic portion 862 is located between the keycap 80 and the first magnetic portion 8422. The second magnetic portion 862 and the first magnetic portion 8422 produce a magnetic attraction force F3 (indicated by a line segment with two arrows in the figures) therebetween. In the embodiment, the third frame 86 and the first magnetic portion 8422 are located in the accommodating space 920. The first switch contact 942 and the second switch contact 962 are also located in the accommodating space 920. The upper end of the first frame 842 extends above the upper cover 824 to connect with the keycap 80. Thereby, the upper cover 824 can reduce the probability that an external magnetic object (e.g. steel or iron filings) is attracted by the magnetic attraction force F3 to enter the accommodating space 920 between the second magnetic portion 862 and the first magnetic portion 8422, so that the action stability of the first frame 842 and the third frame 86 is enhanced and the reliability of the electrical contacts between the third frame 86 and the first switch contact 942 and the second switch contact 962 is also enhanced. In addition, in practice, if the switch structure 9 has additional dust-proof structure, the upper cover 824 can be omitted; thereby, the first frame 842 and the second frame 844 can be connected directly to the carrier 92.

Figure 33:
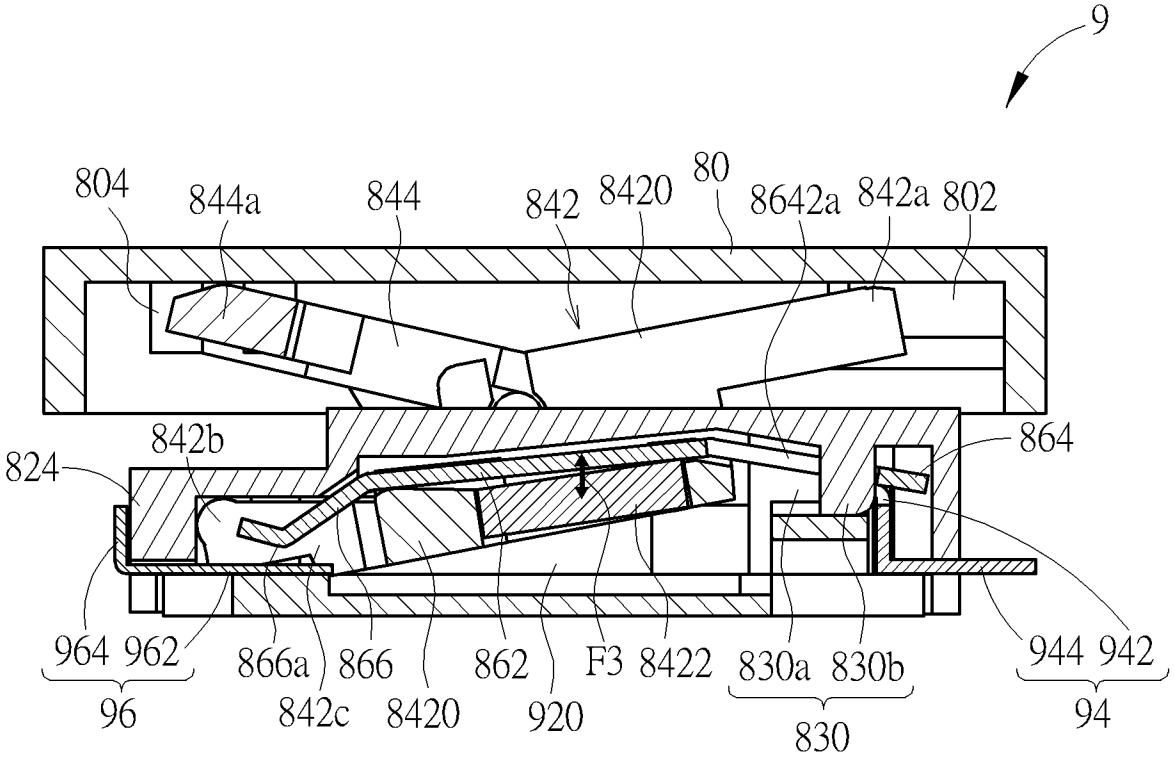
FIG. 33 is a sectional view of the switch structure in FIG. 29 along the line Z-Z when a keycap thereof is not pressed with an external force yet and is located at an unpressed position.
Figure 34:
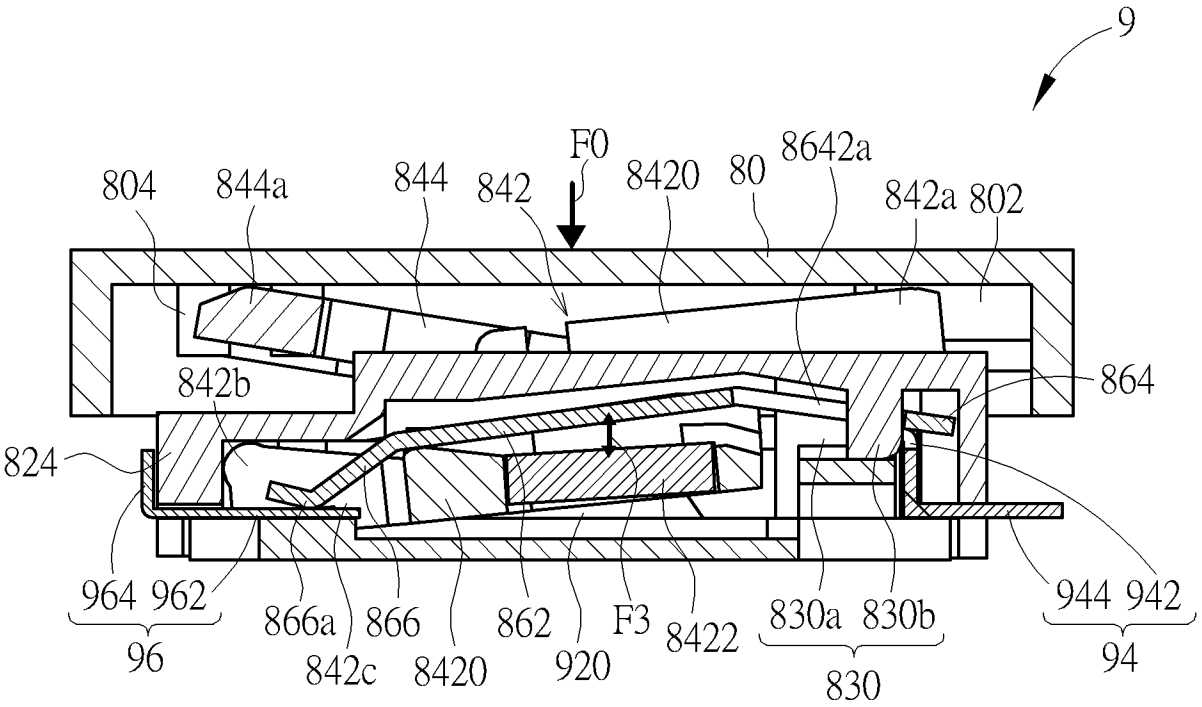
FIG. 34 is a sectional view of the switch structure in FIG. 29 along the line Z-Z when the keycap is pressed with the external force to move to a triggering position.

As shown by FIG. 33, in the switch structure 9, when the keycap 80 is not pressed with an external force F0, and the keycap 80 is located at an unpressed position (or an initial position), the magnetic attraction force F3 makes the first magnetic portion 8422 and the second magnetic portion 862 have a tendency to keep approaching each other, so that the first frame 842 and the third frame 86 are stably supported on the carrier 92 to make the keycap 80 remain at the unpressed position. When the keycap 80 is pressed with the external force F0 to move down from the unpressed position (as shown by FIG. 33) toward a triggering position (as shown by FIG. 34), the first magnetic portion 8422 and the second magnetic portion 862 depart from each other, and the triggering portion 866*a* moves toward the carrier 92. Therein, the second magnetic portion 862 is located between the supporting portion 864 and the triggering portion 866*a*, so during the movement of the keycap 80 toward the carrier 92, the third frame 86 rotates substantially about the supporting portion 864, so that the triggering portion 866*a* can move toward the second switch contact 962.

When the keycap 80 moves toward the carrier 92 from the unpressed position (as shown by FIG. 33) to reach the triggering position under the external force F0, the third frame 86 electrically conducts the second switch contact 942 and the second switch contact 962 through the triggering portion 866*a*, as shown by FIG. 34. Therein, in the embodiment, the third frame 86 is made of a metal plate, so the triggering portion 866*a* and the supporting portion 864 are electrically conducted. The supporting portion 864 keeps abutting against the first switch contact 942; that is, the supporting portion 864 keeps electrically contacting the first switch contact 942. As shown by FIG. 34, when the keycap 80 moves down and reaches the triggering position, the triggering portion 866*a* is driven to move down to electrically contact the second switch contact 962, so that the first switch contact 942 and the second switch contact 962 are electrically conducted.

Figure 35:
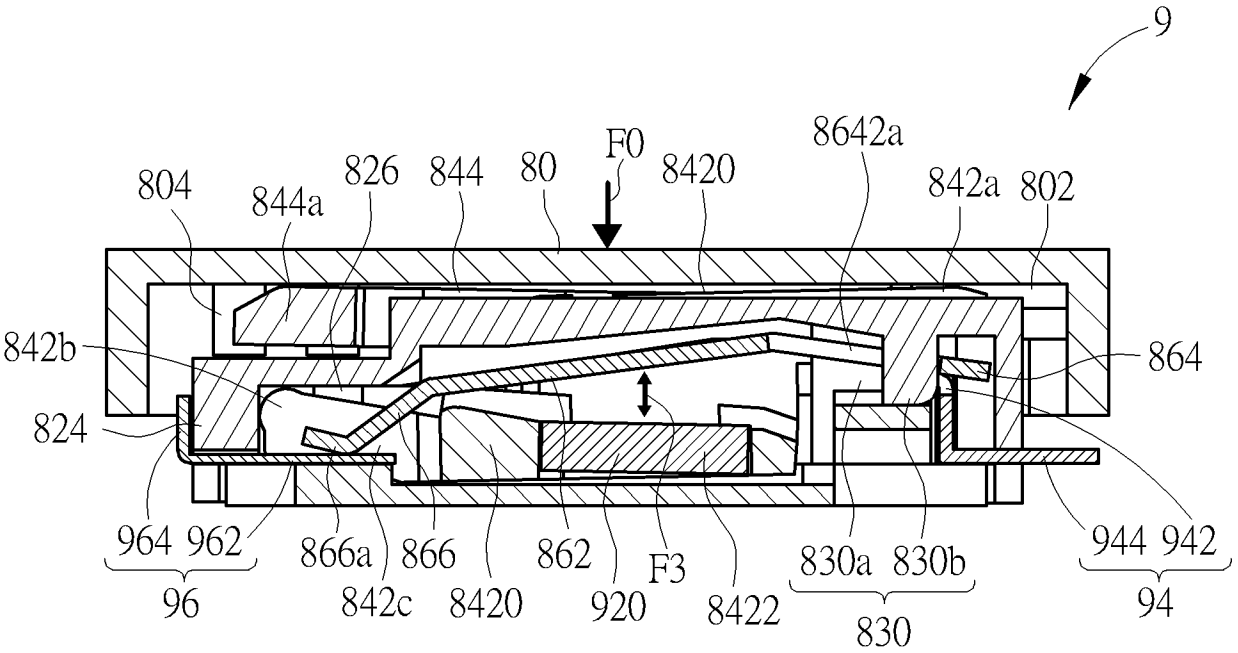
FIG. 35 is a sectional view of the switch structure in FIG. 29 along the line Z-Z when the keycap is pressed with the external force to move to a pressed position.

After the triggering portion 866*a* contacts the second switch contact 962, the first frame 842 will proceed to rotate as the keycap 80 move downward further, but the third frame 86 will not synchronously rotate as the first frame 842 rotates in principle and the extending arm 866 and the first frame 842 are separate. During the movement of the keycap 80 moving toward the carrier 92 from the triggering position (as shown by FIG. 34) to a pressed position (as shown by FIG. 35) under the external force F0, the triggering portion 866*a* keeps contacting the second switch contact 962 and the triggering force applied to the second switch contact 962 by the triggering portion 866*a* does not increase substantially (ignoring the effect on the triggering force due to the variation of the magnetic attraction force F3 based on the increasing of the distance between the first magnetic portion 8422 and the second magnetic portion 862), which can prolong the service life of the second switch contact 962.

When the external force F0 for pressing the keycap 80 downward disappears (e.g. removing the user's finger away from the keycap 80), the magnetic attraction force F3 drives the first magnetic portion 8422 and the second magnetic portion 862 to approach each other, so that the keycap 80 moves from the relatively low pressed position, through the triggering position, and back to the relatively high initial position (i.e. the position where the keycap 80 is not pressed, or the unpressed position) and the first frame 842 and the third frame 86 contact each other and are stably supported on the carrier 92, as shown FIG. 33.

Compared with the keyswitch structure 8, the carrier 92 of the switch structure 9 is equivalent to the lower plate 822 of the keyswitch structure 8 in structural function, so the action logic of the switch structure 9 is substantially the same as that of the keyswitch structure 8. Therefore, in principle, if the lower plate 822 of the keyswitch structure 8 is replaced with the carrier 92, then the above descriptions of the keyswitch structure 8 and the variants thereof (including the embodiment that uses only the first frame 842 as the lift mechanism 84, and the embodiment that uses the balance bar 85) also can be applicable to the switch structure 9. Therefore, for other descriptions about the switch structure 9 and possible variants thereof, please refer to the relevant descriptions of the keyswitch structure 8 and the variants thereof, which will not be described repeatedly.

Figure 36:
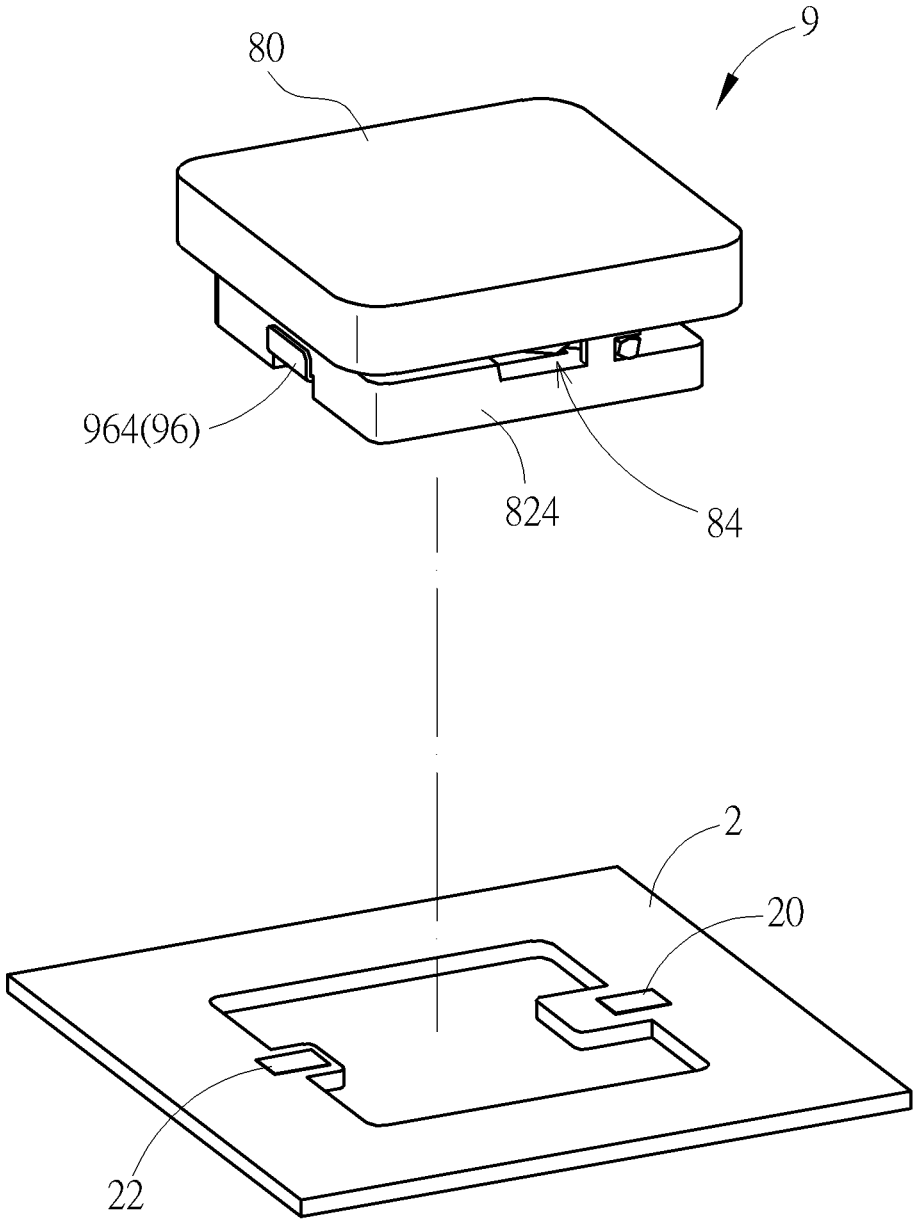
FIG. 36 is a schematic diagram illustrating the switch structure in FIG. 29 being soldered onto an external circuit board.

In addition, in the embodiment, the switch structure 9 has exposed switch contacts (i.e. the first exposed contact 944 and the second exposed contact 964), so the switch structure 9 can be used as a switch unit in circuitry. For example, the switch structure 9 can be soldered onto an external circuit board 2 (is shown in the figure without showing the circuit layout and electronic components thereon for simplification of the figure), as shown by FIG. 36. Therein, the first terminal 94 is soldered onto a solder pad 20 of the circuit board 2 through the first exposed contact 944. The second terminal 96 is soldered onto another solder pad 22 of the circuit board 2 through the second exposed contact 964.

In addition, it is added that in practice, the carrier 92 can be realized directly by a circuit board, and the first terminal 94 and the second terminal 96 are disposed on the circuit board. Therein, the first terminal 94 and the second terminal 96 respectively can be a metal part soldered onto a corresponding solder pad of the circuit board. Or the circuit board is a double layer circuit board having two pairs of solder pads on its top surface and bottom surface. The solder pads on the top surface are used as the first switch contact 942 and the second switch contact 962. The solder pads on the bottom surface are used as the first exposed contact 944 and the second exposed contact 964. In this case, the switch structure can be used as a surface-mount device (SMD). Furthermore, after the switch structure 9 is soldered onto the circuit board 2, the configuration of the combination of the switch structure 9 and the circuit board 2 is equivalent to the configuration of the keyswitch structure 8; therein, the upper cover 824, the carrier 92, the first terminal 94, the second terminal 96, and the circuit board 2 are equivalent to the base 82 of the keyswitch structure 8. In addition, in the above embodiments, the group of the first magnetic portion 1422 or 8422 and the second magnetic portion 162 or 862 in the keyswitch structures 1, 3, 5, 7, 8, 8*a* and 8*b* and the switch structure 9 is equivalent to a return force device in logic. The return force device provides the keycap 10 or 80 with a return force (i.e. produced by the magnetic attraction force F1 or F3) for moving the keycap 10 or 80 from the pressed position toward the unpressed position.

Figure 37:
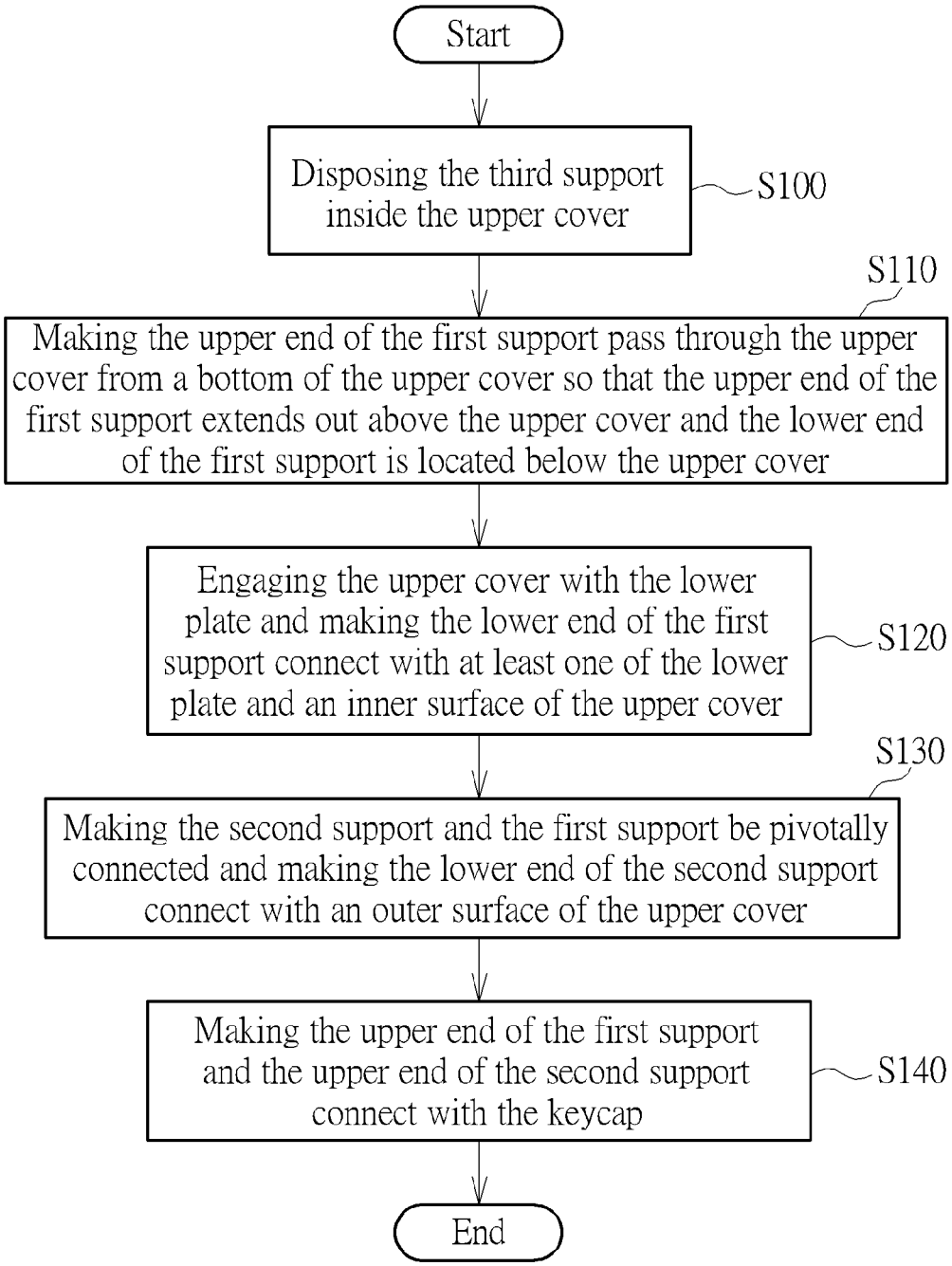
FIG. 37 is a flowchart of a method of assembling a keyswitch structure according to an embodiment.

Please refer to FIG. 37, which is a flowchart of a method of assembling a keyswitch structure according to an embodiment. For simple illustration, FIG. 37 is based on the keyswitch structure 8. For other descriptions about the method, please refer to the relevant descriptions of the keyswitch structure 8 and the figures thereof. As shown by FIG. 37, the method includes disposing the third frame 86 inside the upper cover 824, as shown by the step S100; therein, the second engagement structure 8642 of the third frame 86 and the first engagement structure 830 of the upper cover 824 are engaged. The method includes then making the upper end (i.e. end portion 842*a*) of the first frame 842 pass through the upper cover 824 from a bottom of the upper cover 824 so that the upper end of the first frame 842 extends out above the upper cover 824 and the lower end (i.e. end portion 842*b*) of the first frame 842 is located below the upper cover 824, as shown by the step S110; engaging the upper cover 824 with the lower plate 822 and making the lower end of the first frame 842 connect with at least one of the lower plate 822 and an inner surface of the upper cover 824, as shown by the step S120; making the second frame 844 and the first frame 842 be pivotally connected and making the lower end (i.e. end portion 844*b*) of the second frame 844 connect with an outer surface of the upper cover 824 (i.e. connected to the connection portion 828), as shown by the step S130; and making the upper end of the first frame 842 and the upper end (i.e. end portion 844*a*) of the second frame 844 connect with the keycap 80 (i.e. the connection portions 802 and 804 thereof), as shown by the step S140.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch structure, comprising: a keycap; a base; a first frame, disposed between the keycap and the base, the first frame comprising a first magnetic portion, the keycap being supported on the first frame and being up and down movable relative to the base through the first frame; and a third frame, disposed between the keycap and the base, the third frame comprising a supporting portion and a second magnetic portion, the third frame being supported on the base through the supporting portion, the second magnetic portion being located between the keycap and the first magnetic portion, the second magnetic portion and the first magnetic portion producing a magnetic attraction force therebetween; wherein when the keycap is not pressed, the magnetic attraction force drives the first magnetic portion and the second magnetic portion to approach each other so that the first frame and the third frame are supported on the base stably, and when the keycap is pressed with an external force to move toward the base, the first frame rotates toward the base so that the first magnetic portion and the second magnetic portion depart from each other, wherein the third frame comprises an extending arm, the extending arm is located between the keycap and the first frame, the third frame is rotatably supported on the base through the supporting portion, when the keycap is pressed with the external force to move toward the base, and the magnetic attraction force drives the extending arm to apply a force to the first frame toward the base; wherein the base comprises a switch, the extending arm has a triggering portion protruding toward the switch, and when the keycap is pressed with the external force to move toward the base, the triggering portion triggers the switch.

2. The keyswitch structure of claim 1, wherein in a movement of the keycap toward the base when the keycap is pressed with the external force, the keycap moves from an initial position through a triggering position to a pressed position, and when the keycap reaches the triggering position, the triggering portion triggers the switch.

3. The keyswitch structure of claim 1, wherein when the keycap is not pressed, the magnetic attraction force drives the first magnetic portion and the second magnetic portion to approach each other so that the first frame and the third frame contact each other and are supported on the base stably.

4. The keyswitch structure of claim 1, further comprising a second frame disposed between the keycap and the base, the first frame and the second frame being pivotally connected, the keycap being supported on the first frame and the second frame and being up and down movable relative to the base through the first frame and the second frame.

5. A keyswitch structure, comprising:

a keycap;

a base, comprising first switch contact and a second switch contact;

a first frame, disposed between the keycap and the base, the first frame comprising a first magnetic portion, the keycap being supported on the first frame and being up and down movable relative to the base through the first frame; and a third frame, disposed between the keycap and the base, the third frame comprising a supporting portion, a second magnetic portion, and a triggering portion, the supporting portion and the triggering portion being located at two opposite sides of the third frame respectively, the third frame being rotatably supported on the base through the supporting portion, the second magnetic portion being located between the keycap and the first magnetic portion, the second magnetic portion and the first magnetic portion producing a magnetic attraction force therebetween;

wherein when the keycap is not pressed with any external force, the magnetic attraction force drives the first magnetic portion and the second magnetic portion to approach each other so that the first frame and the third frame are supported on the base stably to render the keycap located at an unpressed position;

when the keycap is pressed with an external force to move downward from the unpressed position toward to a triggering position, the first magnetic portion and the second magnetic portion depart from each other, the magnetic attraction force drives the third frame to rotate about the supporting portion, and the triggering portion moves toward the base; and when the keycap moves toward the base to the triggering position, the third frame abuts against the second switch contact through the triggering portion so that the first switch contact and the second switch contact are electrically conducted.

6. The keyswitch structure of claim 5, wherein the triggering portion and the supporting portion are electrically conducted, the supporting portion is electrically coupled to the first switch contact, and when the keycap moves toward the base to the triggering position, the triggering portion is electrically coupled to the second switch contact in response to the triggering portion abutting against the second switch contact.

7. The keyswitch structure of claim 5, wherein when the keycap moves toward the base to the triggering position, the triggering portion simultaneously contacts both the first switch contact and the second switch contact, so that an electric current is capable to flow from the first switch contact to the second switch contact through the triggering portion.

8. The keyswitch structure of claim 5, wherein the third frame comprises an extending arm, the extending arm is located between the keycap and the base, the triggering portion is located on the extending arm, and when the keycap is pressed with the external force to move toward the base, the magnetic attraction force drives the third frame to move toward the base and keep the third frame abutting the first frame.

9. The keyswitch structure of claim 8, wherein the third frame comprises two engaging portions and two slots, the extending arm is located between the two engaging portions, each of the two slots are formed between the engaging portion and the extending arm, and when the keycap is pressed with the external force to move toward the base, the two slots allows the extending arm to deform upward and the two engaging portions to simultaneously keep abutting the first frame.

10. The keyswitch structure of claim 8, wherein the third frame comprises two engaging portions, the two engaging portions are located at two opposite sides of the third frame respectively, the extending arm is located between the two engaging portions, the first frame comprises two ends and an indentation, the two ends are located at two opposite sides of the indentation respectively, and the extending arm extends into the indentation toward the second switch contact.

11. The keyswitch structure of claim 5, wherein the base comprises a lower plate and an upper cover, the upper cover is disposed on the lower plate, so that the upper cover and the lower plate form an accommodating space, the third frame and the first magnetic portion are located in the accommodating space, and an upper end of the first frame extends above the upper cover to connect with the keycap.

12. The keyswitch structure of claim 11, wherein the upper cover has a first engagement structure, the supporting portion has a second engagement structure, and the third frame is rotatable around where the first engagement structure and the second engagement structure are engaged.

13. The keyswitch structure of claim 5, further comprising a second frame disposed between the keycap and the base, the first frame and the second frame being movably connected to two opposite sides of the keycap respectively, the keycap being up and down movable relative to the base through the first frame and the second frame.

14. A keyswitch structure, comprising:

a keycap;

a lower plate;

a return force device, disposed between the lower plate and the keycap, wherein the return force device comprises a first magnetic portion and a second magnetic portion and provides a return force to the keycap, so that the keycap moves from a pressed position toward an unpressed position;

an upper cover, disposed on the lower plate, the upper cover and the lower plate forming an accommodating space, the return force device being located in the accommodating space;

a scissors structure, disposed between the keycap and the lower plate, the scissors structure having a first frame and a second frame, the keycap being up and down movable between the unpressed position and the pressed position through the scissors structure; wherein the first frame has a first frame upper end and a first frame lower end, the first frame upper end extends above the upper cover to connect with the keycap, and the first frame lower end is located in the accommodating space to connect with at least one of the lower plate and an inner surface of the upper cover; wherein the second frame has a second frame upper end and a second frame lower end, the second frame upper end is connected to the keycap, and the second frame lower end is connected to an outer surface of the upper cover without entering the accommodating space; and a third frame, the third frame being disposed between the keycap and the lower plate and comprising a supporting portion and a triggering portion, the supporting portion and the triggering portion being located at two opposite sides of the third frame respectively, the third frame being rotatably supported on the lower plate through the supporting portion, the lower plate having a first switch contact and a second switch contact, when the keycap moves toward the lower plate to a triggering position, the third frame abutting against the second switch contact through the triggering portion, so that the first switch contact and the second switch contact are electrically conducted; wherein the first magnetic portion and the second magnetic portion are disposed on the first frame and the third frame respectively, and the second magnetic portion and the first magnetic portion magnetically attract each other to produce the return force.

* * * * *